US012729471B2

(12) United States Patent
Cho et al.

(10) Patent No.: US 12,729,471 B2
(45) Date of Patent: Sep. 8, 2026

(54) WASHING MACHINE AND CONTROLLING METHOD OF WASHING MACHINE

(71) Applicant: SAMSUNG ELECTRONICS CO., LTD., Suwon-si (KR)

(72) Inventors: Youngjin Cho, Suwon-si (KR); Kanghyun Lee, Suwon-si (KR); Dongpil Seo, Suwon-si (KR); Jaeryong Park, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 252 days.

(21) Appl. No.: 18/207,927

(22) Filed: Jun. 9, 2023

(65) Prior Publication Data

US 2023/0416964 A1 Dec. 28, 2023

Related U.S. Application Data

(63) Continuation of application No. PCT/KR2023/007539, filed on Jun. 1, 2023.

(30) Foreign Application Priority Data

Jun. 28, 2022 (KR) ..... 10-2022-0079296
Oct. 11, 2022 (KR) ..... 10-2022-0130088

(51) Int. Cl.
*D06F 33/42* (2020.01)
*D06F 33/47* (2020.01)
(Continued)

(52) U.S. Cl.
CPC ..... *D06F 33/42* (2020.02); *D06F 33/47* (2020.02); *D06F 2103/42* (2020.02);
(Continued)

(58) Field of Classification Search
CPC ..... D06F 33/42; D06F 33/43; D06F 33/47; D06F 39/10; D06F 39/082;
(Continued)

(56) References Cited

U.S. PATENT DOCUMENTS 9,982,383 B2 5/2018 Xu et al.
11,261,558 B2 3/2022 Eiselt et al.
(Continued)

FOREIGN PATENT DOCUMENTS

CN 104153162 A 11/2014
CN 216129841 U 3/2022
(Continued)

OTHER PUBLICATIONS

Machine Translation of Nomura, JP-2009089947-A, Oct. 2007. (Year: 2007).*
(Continued)

*Primary Examiner* — David G Cormier
(74) *Attorney, Agent, or Firm* — STAAS & HALSEY LLP

(57) ABSTRACT

A washing machine includes: a housing; a tub inside the housing; a case connected with the tub; a filter attachable to or detachable from the case; a filtering flow path formed to pass through a portion of the filter; a bypass flow path formed to bypass the portion of the filter; and at least one sensor configured to obtain information about a state of the filter. The washing machine includes; a flow path switching device configured to guide water entered into the case to the filtering flow path or the bypass flow path; and a controller configured to control the flow path switching device to guide the water based on the obtained information about the state of the filter.

19 Claims, 23 Drawing Sheets

(51) Int. Cl.

| | |
|---|---|
| *D06F 103/42* | (2020.01) |
| *D06F 105/08* | (2020.01) |
| *D06F 105/58* | (2020.01) |
| *D06F 105/62* | (2020.01) |

(52) U.S. Cl.
CPC ..... *D06F 2105/08* (2020.02); *D06F 2105/58* (2020.02); *D06F 2105/62* (2020.02)

(58) Field of Classification Search
CPC ..... D06F 2103/42; D06F 2105/08; D06F 2105/34; D06F 2105/58; D06F 2105/62; B01D 35/14; B01D 35/147
See application file for complete search history.

(56) References Cited

U.S. PATENT DOCUMENTS

| | | | | |
|---|---|---|---|---|
| 11,629,452 | B2 | 4/2023 | Kang et al. | |
| 2009/0320530 | A1* | 12/2009 | Kim | D06F 34/28 68/12.27 |
| 2012/0186306 | A1 | 7/2012 | Kim et al. | |
| 2018/0148883 | A1* | 5/2018 | Rajendran | D06F 39/10 |
| 2020/0316501 | A1* | 10/2020 | Jones | B04B 15/06 |
| 2021/0108349 | A1* | 4/2021 | Carpenter | D06F 39/02 |
| 2022/0008845 | A1 | 1/2022 | Girondi | |
| 2022/0298695 | A1 | 9/2022 | Lee et al. | |
| 2024/0238702 | A1 | 7/2024 | Lawrence-Owen et al. | |

FOREIGN PATENT DOCUMENTS

| | | | | |
|---|---|---|---|---|
| CN | 112442877 | B | 4/2022 | |
| DE | 10 2017 215 132 | A1 | 2/2019 | |
| EP | 3 907 322 | A1 | 11/2021 | |
| EP | 4 219 821 | A1 | 8/2023 | |
| JP | 6-286 | | 1/1994 | |
| JP | 6-79094 | | 3/1994 | |
| JP | 9-75589 | | 3/1997 | |
| JP | 2001-79293 | | 3/2001 | |
| JP | 2007-105496 | | 4/2007 | |
| JP | 2009-89947 | | 4/2009 | |
| JP | 2010-88650 | | 4/2010 | |
| JP | 4738318 | | 8/2011 | |
| JP | 2015-66328 | | 4/2015 | |
| JP | 2017-502736 | | 1/2017 | |
| KR | 1998-029485 | | 8/1998 | |
| KR | 1998-062384 | | 11/1998 | |
| KR | 1999-011742 | | 2/1999 | |
| KR | 10-0198254 | | 6/1999 | |
| KR | 20-0157098 | | 9/1999 | |
| KR | 10-0806145 | | 2/2008 | |
| KR | 10-1375717 | | 3/2014 | |
| KR | 10-2020-0070278 | | 6/2020 | |
| KR | 10-2020-0114100 | | 10/2020 | |
| KR | 10-2021-0090193 | | 7/2021 | |
| KR | 10-2443322 | | 9/2022 | |
| KR | 10-2024-0028983 | | 3/2024 | |
| WO | WO-2005089621 | A1 * | 9/2005 | A47L 15/4225 |
| WO | WO-2018086931 | A1 * | 5/2018 | D06F 39/10 |
| WO | WO 2022/203217 | A1 | 9/2022 | |

OTHER PUBLICATIONS

Supplementary European Search Report dated May 8, 2025 issued in European Application No. EP 23 83 1748.
International Search Report dated Sep. 21, 2023 issued in PCT Application No. PCT/KR2023/007539.
Written Opinion dated Sep. 20, 2023, issued in PCT Application No. PCT/KR2023/007539.
Office Action dated Apr. 7, 2026, issued in European Application No. 23 831 748.1.

* cited by examiner

WASHING MACHINE AND CONTROLLING METHOD OF WASHING MACHINE

CROSS-REFERENCE TO RELATED APPLICATION(S)

This application is a continuation application of International Application PCT/KR2023/007539, filed Jun. 1, 2023 claims priority under 35 U.S.C. § 119 to Korean Patent Applications No. 10-2022-0079296, filed on Jun. 28, 2022, and No. 10-2022-0130088, filed on Oct. 11, 2022 in the Korean Intellectual Property Office, the disclosures of which are incorporated by reference herein in their entireties.

BACKGROUND

1. Field

The disclosure relates to a washing machine having a filter and a method for controlling the washing machine.

2. Description of the Related Art

A washing machine is an apparatus for performing washing through friction by stirring laundry, water, and a detergent together inside a tub with a driving force of a driving motor.

Operations that are performed by a washing machine include a washing operation of supplying a detergent and water to a tub accommodating laundry and washing the laundry while rotating a drum, a rinsing operation of rinsing the laundry by supplying water to the tub and rotating the drum, and a dehydrating operation of discharging water from the tub and rotating the drum to remove water from the laundry, regardless of the kind of the washing machine.

The washing machine includes a pump device for discharging water stored in the tub to the outside of the washing machine during the washing operation, the rinsing operation, and/or the dehydrating operation. The pump device is configured to return water discharged from the tub to the tub during the washing operation and/or the rinsing operation.

The pump device includes a filter for filtering foreign materials included in water entered the pump device from the tub. The filter is detachable from the pump device.

SUMMARY

In accordance with a concept of the disclosure, a washing machine includes a housing and a tub inside the housing. The washing machine includes: a case connected with the tub; a filter attachable to or detachable from the case; a filtering flow path formed to pass through a portion of the filter; a bypass flow path formed to bypass the portion of the filter; at least one sensor configured to obtain information about a state of the filter; a flow path switching device configured to guide water entered into the case to the filtering flow path or the bypass flow path; and a controller configured to control the flow path switching device to guide the water based on the obtained information about the state of the filter.

The flow path switching device may include: a bypass door configured to open or close the bypass flow path; and a bypass driver configured to operate the bypass door.

The bypass door may be positioned at a location at which the filtering flow path and the bypass flow path diverge.

The case may include an inlet and a drain opening. The guide may be positioned on a drain flow path connecting the inlet with the drain opening.

The flow path switching device may include a bypass body rotatably supporting the bypass door and installed in the case.

The filter may include a first filter portion to filter a first foreign material, and a second filter portion configured to filter a second foreign material that is smaller than the first foreign material and not filtered by the first filter portion. The filtering flow path may be configured to pass through the second filter portion. The bypass flow path may be configured to bypass the second filter portion.

The washing machine may further include: a pump configured to suck water into inside of the case and discharge the water inside of the case to outside of the case; and a pump motor configured to drive the pump, wherein the at least one sensor may include a current sensor configured to detect a driving current value applied to the pump motor.

The at least one sensor may include a water level sensor configured to detect a water level of the tub.

The at least one sensor may include an optical sensor configured to detect an amount of foreign materials collected in the filter.

The washing machine may further include: a filter blade slidably and rotatably inserted onto an inner surface of the filter; and a blade motor configured to rotate the filter blade. The at least one sensor may include a current sensor configured to detect a driving current value applied to the blade motor.

The controller may be configured to control the flow path switching device to guide the water entered into the case to the bypass flow path, based on an identification, included in the obtained information, that the filter is clogged.

The controller may be configured to control the flow path switching device to guide the water entered into the case to the filtering flow path, based on an identification, included in the obtained information, that the filter is not clogged.

The washing machine may further include a display. The controller may be configured to control the display to display a visual feedback notifying clogging of the filter, based on a detection of clogging of the filter by the at least one sensor.

The washing machine may further include a communicator. The controller may be configured to control the communicator to transmit a filter clogging notification message to a user terminal based on a detection of clogging of the filter by the at least one sensor.

The controller may be configured to interrupt a washing cycle upon receiving of an operation stop command from the user terminal through the communicator.

In accordance with a concept of the disclosure, a washing machine includes: a tub; a case connected with the tub; a filter attachable to or detachable from the case; and at least one sensor configured to detect clogging of the filter. The washing machine includes: a flow path switching device configured to guide water entered into the case to pass through the filter or bypass the filter; and a controller configured to control the flow path switching device based on the clogging of the filter detected by the at least one sensor.

The flow path switching device may include: a bypass door rotatably installed in the case and configured to guide the water entered into the case to pass through the filter or bypass the filter; and a bypass driver configured to rotate the bypass door.

The filter may include a first filter portion, and a second filter portion configured to filter a foreign material that is not filtered by the first filter portion. The bypass door may be adjacent to a location at which the first filter portion is connected with the second filter portion.

The washing machine may further include: a filter blade slidably and rotatably inserted onto an inner surface of the filter; and a blade motor configured to rotate the filter blade. The at least one sensor may include a current sensor configured to detect a driving current value applied to the blade motor.

In accordance with a concept of the disclosure, a method for controlling a washing machine, the washing machine including a filter attachable to or detachable from a case connected with a tub, at least one sensor to detect clogging of the filter, a filtering flow path formed inside the filter, and a bypass flow path formed between the case and the filter, includes detecting of clogging of the filter by the at least one sensor; and guiding water entered into the case to the bypass flow path based on the detecting of clogging of the filter.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
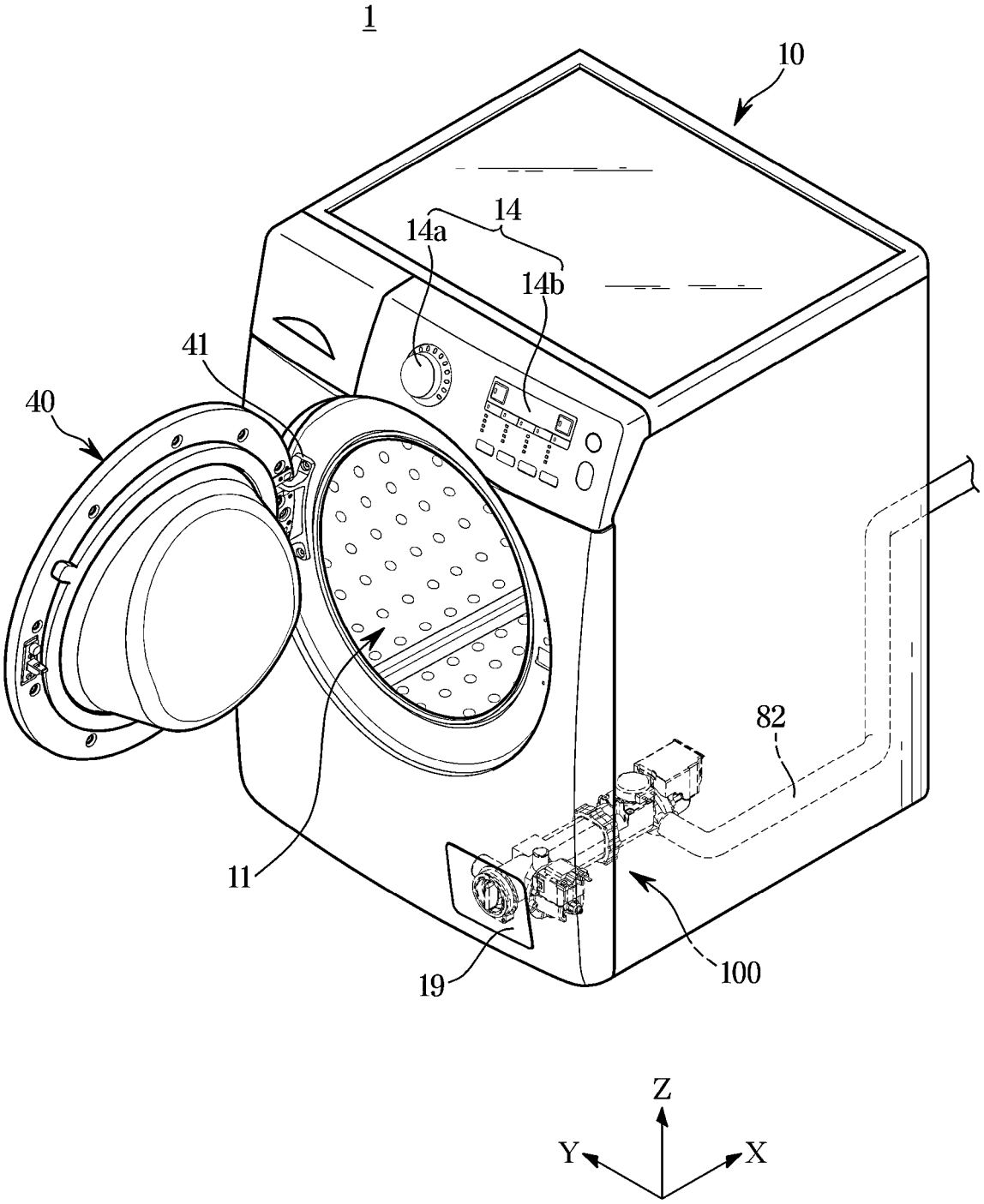
FIG. 1 shows a washing machine according to an embodiment of the disclosure.

Various embodiments of the present disclosure and terms used therein are not intended to limit the technical features described in the present disclosure to particular embodiments, and it should be construed as including various modifications, equivalents, or alternatives of a corresponding embodiment.

With regard to description of drawings, similar reference numerals may be used for similar or related components.

A singular form of a noun corresponding to an item may include one item or a plurality of the items unless context clearly indicates otherwise.

As used herein, each of the expressions "A or B," "at least one of A and B," "at least one of A or B," "A, B, or C," "at least one of A, B, and C," and "at least one of A, B, or C," may include one or all possible combinations of the items listed together with a corresponding expression among the expressions.

The term "and/or" includes any and all combinations of one or more of a plurality of associated listed items.

It will be understood that the terms "first", "second", etc., may be used only to distinguish one component from another, not intended to limit the corresponding component in other aspects (e.g., importance or order).

It is said that one (e.g., first) component is "coupled" or "connected" to another (e.g., second) component, with or without the terms "functionally" or "communicatively". When referenced, it means that one component can be connected to the other component directly (e.g., by wire), wirelessly, or through a third component.

It will be understood that when the terms "includes," "comprises," "including," and/or "comprising," when used in this specification, specify the presence of stated features, figures, steps, operations, components, members, or combinations thereof, but do not preclude the presence or addition of one or more other features, figures, steps, operations, components, members, or combinations thereof.

An expression that one component is "connected", "coupled", "supported", or "in contact" with another component includes a case in which the components are directly "connected", "coupled", "supported", or "in contact" with each other and a case in which the components are indirectly "connected", "coupled", "supported", or "in contact" with each other through a third component.

It will also be understood that when one component is referred to as being "on" or "over" another component, it can be directly on the other component or intervening components may also be present.

An aspect of the disclosure to provide a washing machine capable of discharging water from a pump device although a portion of a filter is clogged.

It is an aspect of the disclosure to provide a washing machine capable of being prevented from stopping although a portion of a filter is clogged.

The technical goals to be achieved by the disclosure are not limited to the technical goals described above, and other technical goals that are not described may be clearly understood by those with ordinary knowledge in the technical field to which the disclosure belongs from the following description.

A washing machine according to various embodiments of the disclosure may be an example of a laundry treating apparatus.

A washing machine according to various embodiments of the disclosure may include a top-loading washing machine in which an inlet for allowing a user to put laundry in or take laundry out faces upward, or a front-loading washing machine in which an inlet for allowing a user to put laundry in or take laundry out faces forward.

The washing machine according to various embodiments of the disclosure may include another type of washing machine, except for the top-loading washing machine and the front-loading washing machine.

The top-loading washing machine may wash laundry by using a water stream generated by a rotating body such as a pulsator. The front-loading washing machine may wash laundry by rotating a drum to repeatedly lift and drop the laundry. The front-loading washing machine may include a lifter for lifting laundry. The washing machine according to various embodiments of the disclosure may include a washing machine using another washing method except for the above-described washing methods.

Hereinafter, a washing machine according to various embodiments of the disclosure will be described in detail with reference to the accompanying drawings.

Figure 2:
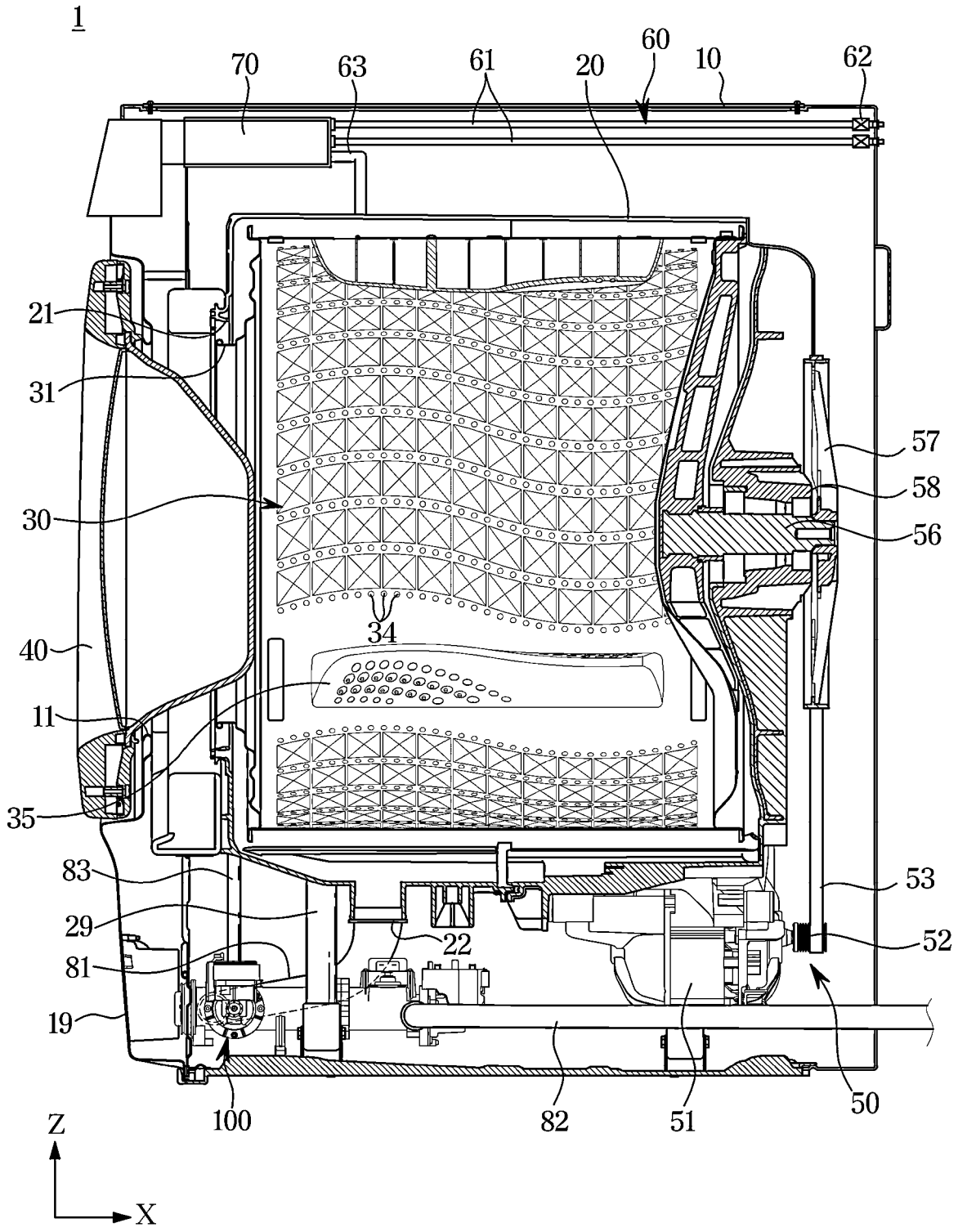
FIG. 2 shows a cross section of the washing machine shown in FIG. 1.

FIG. 1 shows a washing machine according to an embodiment of the disclosure. FIG. 2 shows a cross section of the washing machine shown in FIG. 1.

Referring to FIGS. 1 and 2, a washing machine 1 according to various embodiments of the disclosure may include a housing 10 that accommodates various components therein.

The housing 10 may include a housing opening 11 for allowing an access to inside of a drum 30. A tub 20 may include a tub opening 21 corresponding to the housing opening 11. The drum 30 may include a drum opening 31 corresponding to the housing opening 11 and the tub opening 21. Laundry may be put in the drum 30 or taken out of the drum 30 through the housing opening 11, the tub opening 21, and the drum opening 31. The housing opening 11 may face substantially forward. The drum opening 31 may face substantially forward.

The washing machine 1 may include a control panel 14. The control panel 14 may be provided on the housing 10. The control panel 14 may include an inputter 14*a* for receiving an operation command from a user, and a display 14*b* for displaying operation information of the washing machine 1. The control panel 14 may provide a user interface for enabling a user to interwork with the washing machine 1.

Figure 11:
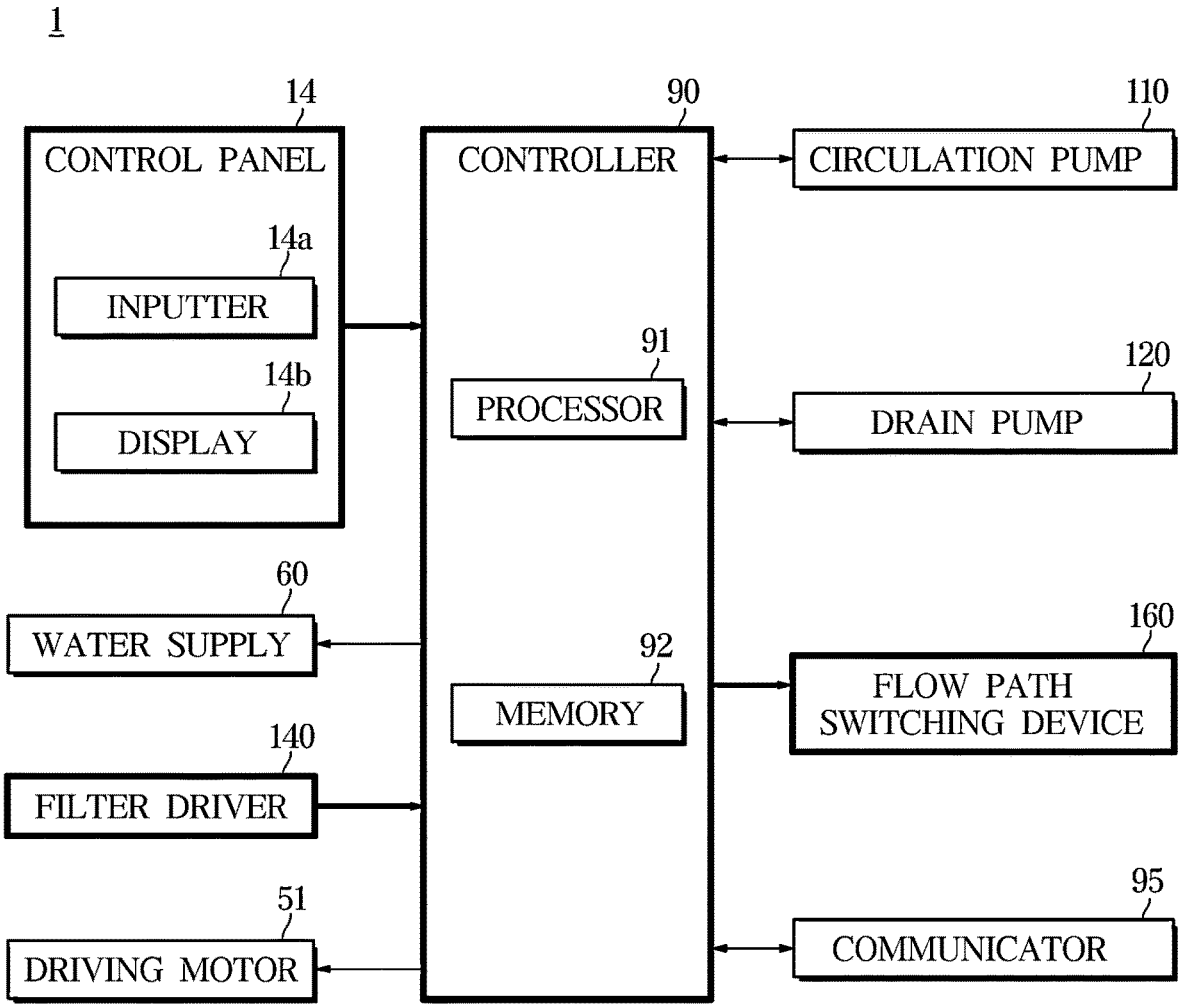
FIG. 11 is a block diagram briefly showing components of a washing machine according to an embodiment of the disclosure and a flow of signals between the components.

The inputter 14*a* may provide an electrical output signal corresponding to a user input to a controller 90 (see FIG. 11). The inputter 14*a* may include, for example, a power button, a start button, a course selection dial (or a course selection button), and a washing/rinsing/dehydrating setting button. The inputter 14*a* may include, for example, a tact switch, a push switch, a slide switch, a toggle switch, a micro switch, or a touch switch.

The display 14*b* may receive a signal from the controller 90, and display information corresponding to the received signal. The display 14*b* may include a screen that displays a washing course selected by a rotation of the course selection dial (or, pressing of the course selection button) and an operation time of the washing machine 1, and an indicator that displays a washing setting/rinsing setting/dehydrating setting selected by the setting button. The display 14*b* may include, for example, a Liquid Crystal Display (LCD) panel, a Light Emitting Diode (LED) panel, etc.

The washing machine 1 may include a door 40 for opening and closing the housing opening 11 provided in the housing 10. The door 40 may be rotatably installed on the housing 10 by a hinge 41. At least one portion of the door 40 may be transparent or translucent to show inside of the housing 10.

The washing machine 1 may include the tub 20 provided inside the housing 10 to store water. The tub 20 may be supported on an inner side of the housing 10. The tub 20 may be substantially in a shape of a cylinder of which one side opens.

The tub 20 may be elastically supported from the housing 10 by a damper 29. The damper 29 may connect the tub 20 with the housing 10. The damper 29 may attenuate vibrations generated during a rotation of the drum 30 by absorbing vibration energy between the tub 20 and the housing 10 upon transferring of the vibrations to the tub 20 and/or the housing 10.

The washing machine 1 may include the drum 30 that accommodates laundry. The drum 30 may be rotatably provided inside the tub 20. The drum 30 may perform washing, rinsing, and/or dehydrating, while rotating inside the tub 20. The drum 30 may include a through hole 34 that connects an inside space of the drum 30 with an inside space of the tub 20. The drum 30 may be substantially in a shape of a cylinder of which one side opens. On an inner circumferential surface of the drum 30, a plurality of lifters 35 may be provided to lift and drop laundry upon a rotation of the drum 30.

The washing machine 1 may include a driver 50 configured to rotate the drum 30. The driver 50 may include a driving motor 51, and a rotating shaft 56 for transferring a driving force generated from the driving motor 51 to the drum 30. The rotating shaft 56 may penetrate the tub 20 and be connected with the drum 30. The driver 50 may rotate the drum 30 forward or backward to perform a washing, rinsing, and/or dehydrating operation.

The drum 30 may be connected with the driving motor 51 through the rotating shaft 56, and according to connection types between the rotating shaft 56 and the driving motor 51, there may be a direct driving type in which the rotating shaft 56 is directly connected with the driving motor 51 to rotate the drum 30, and an indirect driving type in which pulleys 52 and 57 are connected between the driving motor 51 and the rotating shaft 56 to drive the drum 30. FIG. 2 shows a case in which the washing machine 1 is the indirect driving type. However, the washing machine 1 according to various embodiments of the disclosure may be the direct driving type.

The washing machine 1 according to various embodiments of the disclosure may be the indirect driving type. One end of the rotating shaft 56 may be connected with a rear portion of the drum 30, and the other end of the rotating shaft 56 may be connected with a shaft pulley 57 to obtain a driving force from the driving motor 51. A motor pulley 52 may be formed on a rotating shaft of the driving motor 51. A driving belt 53 may be provided between the motor pulley 52 and the shaft pulley 57, and the rotating shaft 56 may be driven by the driving belt 53.

The driving motor 51 may be positioned below the tub 20. The driving belt 53 may drive the rotating shaft 56 while rotating clockwise or counterclockwise in an up-down direction of the tub 20.

In the rear portion of the tub 20, a bearing housing 58 for rotatably supporting the rotating shaft 56 may be installed. The bearing housing 58 may be made of an aluminum alloy. The bearing housing 58 may be inserted into the rear portion of the tub 20 upon injection-molding of the tub 20.

A water supply 60 may supply water to the tub 20. The water supply 60 may include a water supply pipe 61, and a water supply valve 62 provided in the water supply pipe 61. The water supply pipe 61 may be connected with an external water supply source. The water supply pipe 61 may extend from the external water supply source to a detergent supply device 70 and/or the tub 20. Water may be supplied to the tub 20 via the detergent supply device 70. Water may be supplied to the tub 20 without passing through the detergent supply device 70.

The water supply valve 62 may open or close the water supply pipe 61 in response to an electrical signal from the controller 90. The water supply valve 62 may enable water to be supplied from the external water supply source to the tub 20 or block water from being supplied from the external water supply source to the tub 20. The water supply valve 62 may include, for example, a solenoid valve that is opened or closed in response to an electrical signal.

The washing machine 1 may include the detergent supply device 70 configured to supply a detergent to the tub 20. The detergent supply device 70 may supply a detergent to the inside of the tub 20 during a water supply process. Water supplied through the water supply pipe 61 may be mixed with a detergent by passing through the detergent supply device 70. The water mixed with the detergent may be supplied to the inside of the tub 20. The detergent supply device 70 may be connected with the tub 20 through a connecting pipe 63. The detergent may include a detergent, a dryer conditioner, a deodorant, a sanitizer, or an air freshener.

The washing machine 1 may include a pump device 100. The pump device 100 may discharge water accommodated in the tub 20 to the outside. The pump device 100 may be connected with the tub 20.

The washing machine 1 may include a connecting guide 81 connecting the tub 20 with the pump device 100 such that water stored in the tub 20 enters the pump device 100. The connecting guide 81 may guide water discharged from the tub 20 to the pump device 100. In a bottom of the tub 20, a drain 22 for draining water stored in the tub 20 to the outside of the tub 20 may be formed. The drain 22 may be connected with the connecting guide 81.

The washing machine 1 may include a drain guide 82 extending from the pump device 100 to the outside of the housing 10 to discharge water entered the pump device 100 to the outside of the housing 10. The drain guide 82 may guide water of the pump device 100 to the outside of the housing 10. The drain guide 82 may guide water pumped by a drain pump 120.

To circulate water entered the pump device 100 to the tub 20, the washing machine 1 may include a circulation guide 83 extending from the pump device 100 to the tub 20. The circulation guide 83 may guide water of the pump device 100 to the tub 20.

In a front lower portion of the housing 10, a cover 19 covering the pump device 100 may be provided. A user may access the pump device 100 by opening the cover 19.

Figure 3:
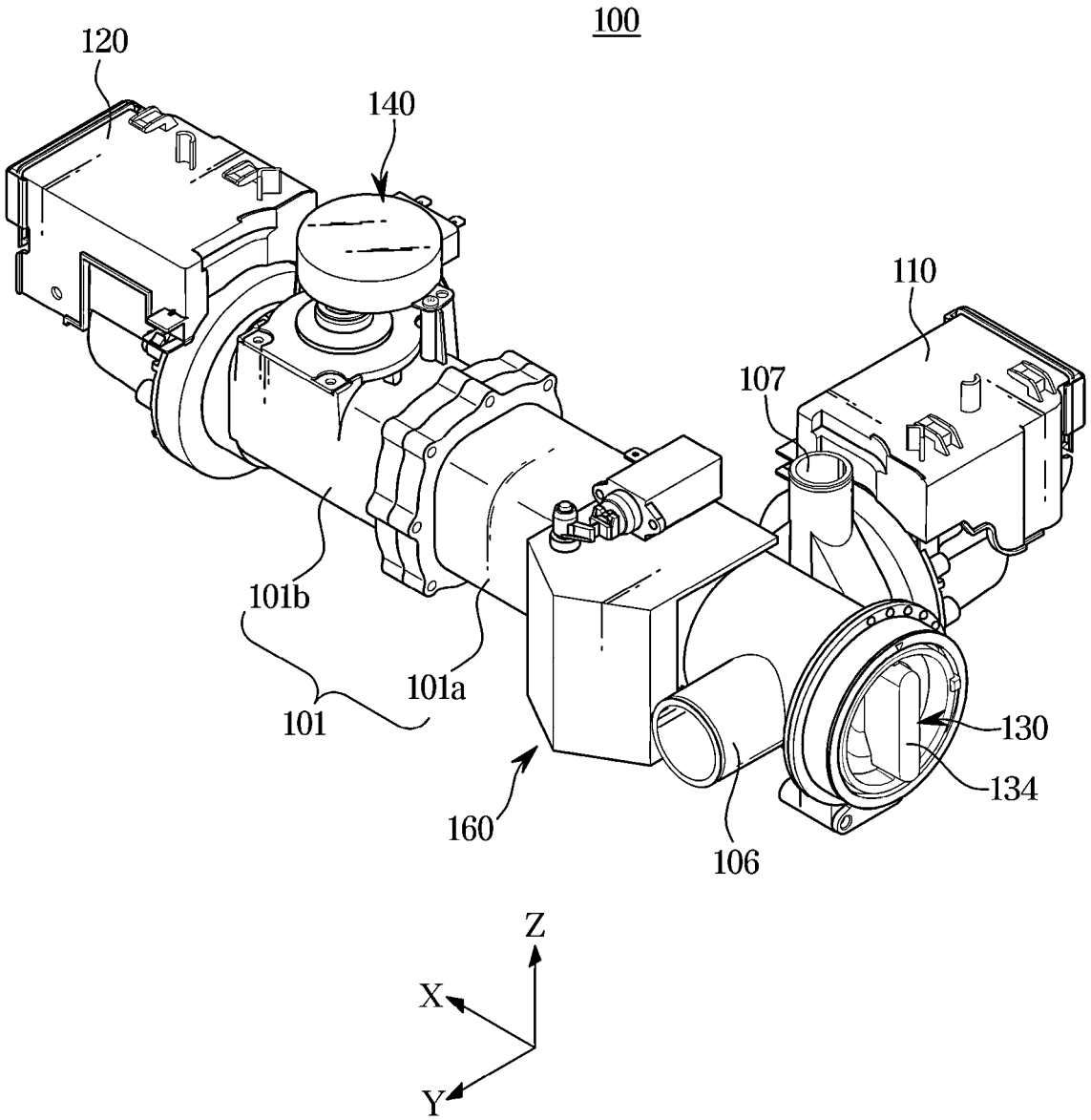
FIG. 3 shows a pump device shown in FIG. 2.
Figure 4:
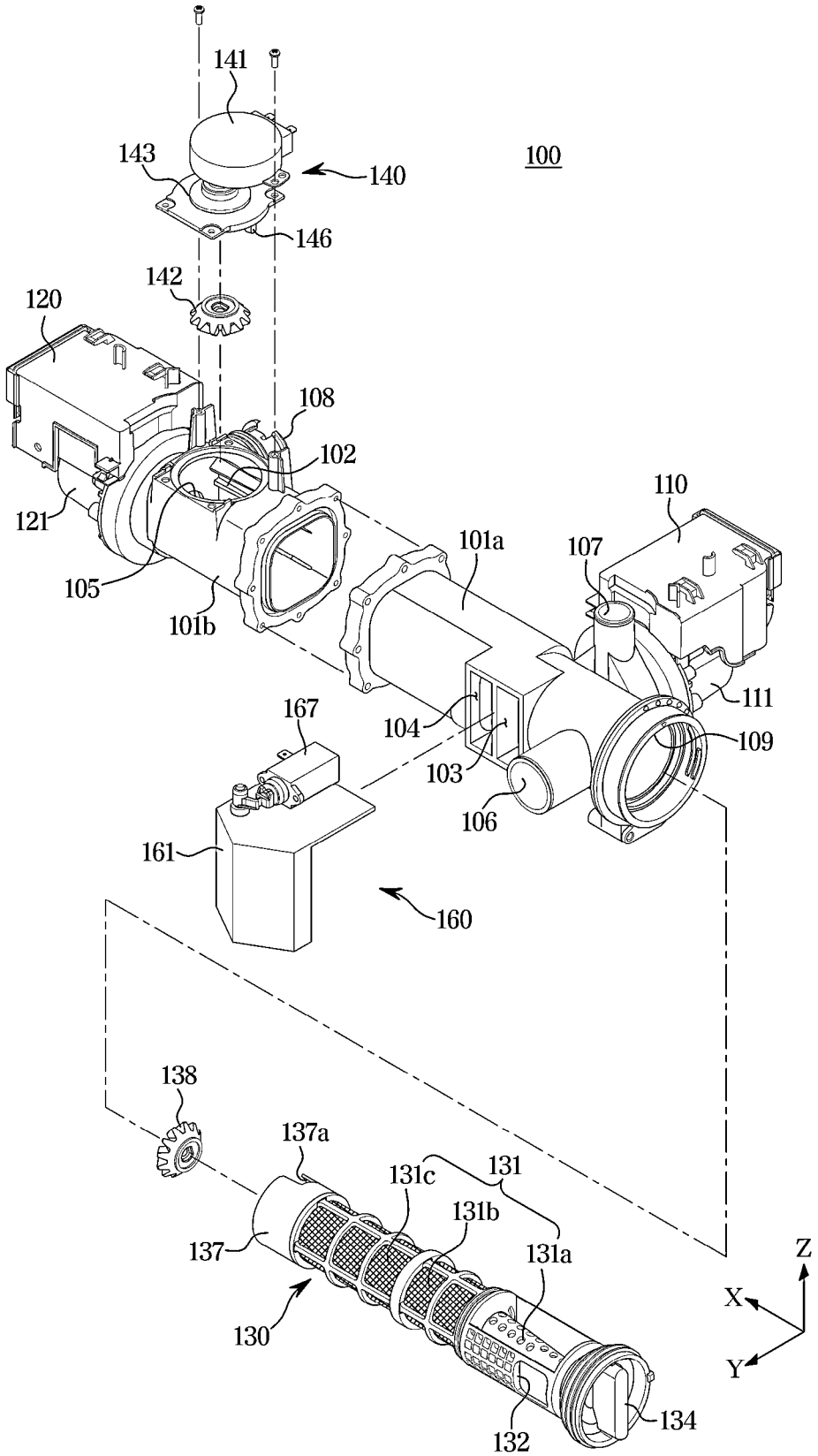
FIG. 4 is an exploded view of the pump device shown in FIG. 3.
Figure 5:
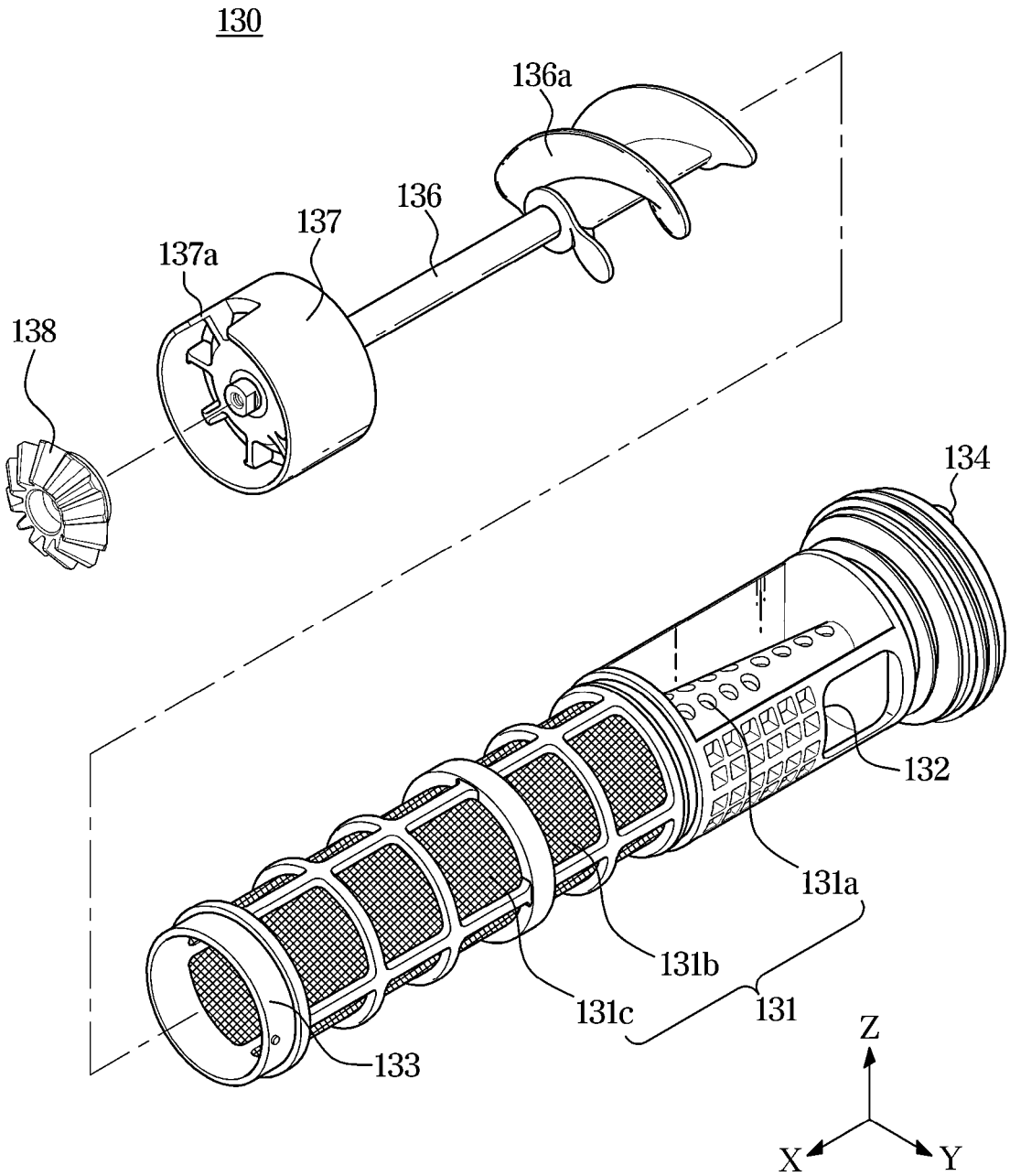
FIG. 5 is an exploded view of a filter device shown in FIG. 4.
Figure 6:
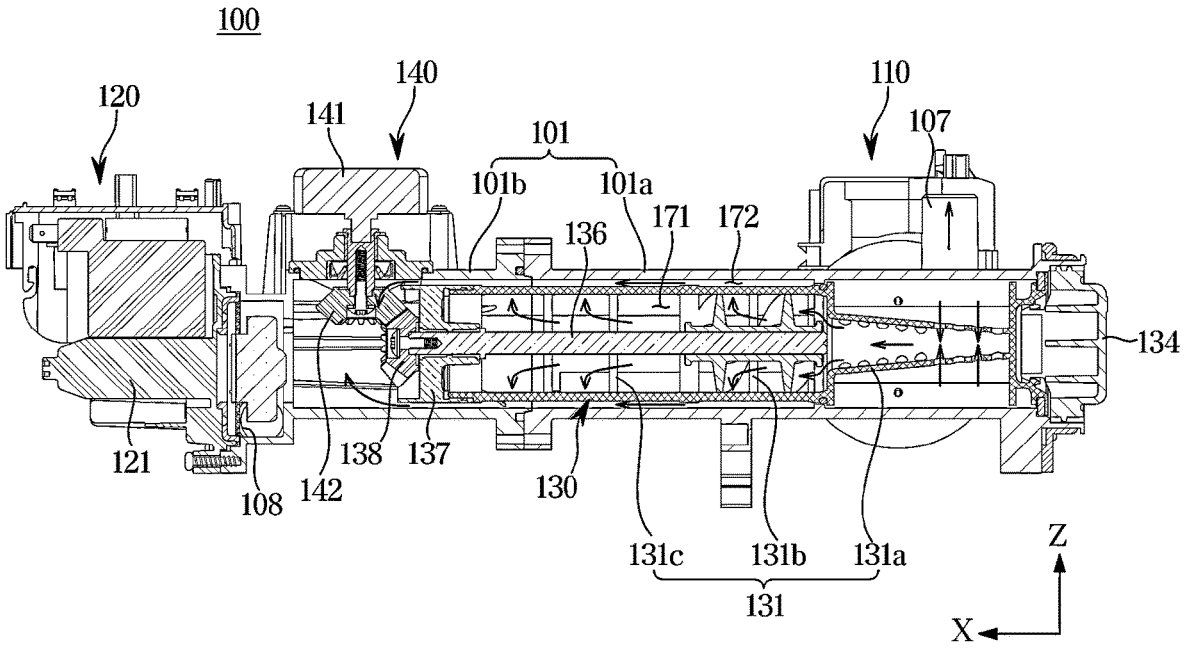
FIG. 6 shows a cross section of the pump device shown in FIG. 3, taken along an X-Z plane.

FIG. 3 shows the pump device shown in FIG. 2. FIG. 4 is an exploded view of the pump device shown in FIG. 3. FIG. 5 is an exploded view of a filter device shown in FIG. 4. FIG. 6 shows a cross section of the pump device shown in FIG. 3, taken along an X-Z plane.

Referring to FIGS. 2 to 4, the pump device 100 may be positioned below the tub 20. The pump device 100 may circulate water stored in the tub 20 or discharge water stored in the tub 20 to the outside of the washing machine 1.

The pump device 100 may include a case 101, and a plurality of pumps 110 and 120 installed on the case 101. The pumps 110 and 120 may include a circulation pump 110 and the drain pump 120.

The case 101 may form an outer appearance of the pump device 100. The case 101 may extend in an X-axis direction. The case 101 may accommodate a filter device 130. The circulation pump 110 may be installed on the case 101. The drain pump 120 may be installed on the case 101. A filter driver 140 may be installed on the case 101. The case 101 may include a first case 101*a*, and a second case 101*b* detachably coupled to the first case 101*a*. The case 101 may be connected with the tub 20.

The circulation pump 110 may be installed on the first case 101*a*. An inlet 106 connected with the connecting guide 81 may be formed in the first case 101*a*. Water stored in the tub 20 may enter the pump device 100 through the inlet 106. A circulation opening 107 connected with the circulation guide 83 may be formed in the first case 101*a*. The circulation opening 107 may be adjacent to the circulation pump 110 to guide water circulating to the tub 20 by the circulation pump 110. In the first case 101*a*, a filter inserting opening 109 in which the filter device 130 is inserted may be formed.

The drain pump 120 may be installed on the second case 101*b*. A drain opening 108 connected with the drain guide 82 may be formed in the second case 101*b*. To guide water discharged to the outside of the housing 10 by the drain pump 120, the drain opening 108 may be adjacent to the drain pump 120. The filter driver 140 may be installed on the second case 101*b*. A driver inserting hole 105 in which a portion of the filter driver 140 is inserted may be formed in the second case 101*b*.

The inlet 106 may be substantially perpendicular to the circulation opening 107. The inlet 106 may extend in a Y-axis direction. The circulation opening 107 may extend in a Z-axis direction. The inlet 106 and the circulation opening 107 may be formed in one end of the case 101 in which the circulation pump 110 is positioned. The inlet 106 and/or the circulation opening 107 may be adjacent to the circulation pump 110.

The drain opening 108 may be substantially perpendicular to the direction in which the case 101 extends. The drain opening 108 may extend in the Y-axis direction. The drain opening 108 may be formed in the other end of the case 101, which is opposite to the one end of the case 101 in which the circulation pump 110 is positioned. The drain opening 108 may be positioned in the other end of the case 101, in which the drain pump 120 is positioned. The drain opening 108 may be adjacent to the drain pump 120.

The pump device 100 may include the circulation pump 110 for circulating water stored in the tub 20. The circulation pump 110 may be installed in the case 101. The circulation pump 110 may be installed on the first case 101*a*. The circulation pump 110 may be positioned in the one end of the case 101 in which the inlet 106 is formed. The circulation pump 110 may be adjacent to the inlet 106. The circulation pump 110 may be opposite to the inlet 106. The circulation pump 110 may include a circulation pump motor 111 for generating a rotation force in the Y-axis direction. The circulation pump motor 111 may form a water stream for discharging water entered the inlet 106 through the circulation opening 107.

The pump device 100 may include the drain pump 120 for discharging water stored in the tub 20 to the outside of the housing 10. The drain pump 120 may be installed on the case 101. The drain pump 120 may be installed on the second case 101*b*. The drain pump 120 may be positioned in the other end of the case 101, the other end being opposite to the one end of the case 101 in which the inlet 106 is formed. The drain pump 120 may be more distant from the inlet 106 than the circulation pump 110. The drain pump 120 may include a drain pump motor 121 for generating a rotation force in the X-axis direction. The drain pump motor 121 may form a water stream for discharging water entered the inlet 106 through the drain opening 108.

A rotation axis (being parallel to the Y-axis direction) of the circulation pump motor 111 may be different from a rotation axis (being parallel to the X-axis direction) of the drain pump motor 121. The rotation axis of the circulation pump motor 111 may be perpendicular to the rotation axis of the drain pump motor 121.

Referring to FIGS. 4 and 5, the pump device 100 may include the filter device 130 for filtering water that is discharged through the drain pump 120. The filter device 130 may extend in the X-axis direction. The filter device 130 may be accommodated in the case 101. The filter device 130 may filter water entered the pump device 100. The filter device 130 may filter water entered the pump device 100. The filter device 130 may be detachably installed in the case 101.

The filter device 130 may include a filter 131, and a filter blade 136 rotatably provided inside the filter 131.

The filter 131 may be detachably installed inside the case 101. The filter 131 may be positioned between the circulation pump 110 and the drain pump 120. The filter 131 may include a first filter portion 131*a*, a second filter portion 131*b*, and a third filter portion 131*c*. The filter 131 may include a filter opening 132 that opens toward the inlet 106 in a state in which the filter 131 is installed in the case 101. Water entered the inlet 106 may move to inside of the filter 131 through the filter opening 132.

The water entered the inside of the filter 131 through the filter opening 132 may be primarily filtered in the first filter portion 131*a*. The first filter portion 131*a* may include a plurality of openings. The first filter portion 131*a* may filter foreign materials having relatively large sizes. The water filtered in the first filter portion 131*a* may move to the tub 20 by the circulation pump 110. The water filtered in the first filter portion 131*a* may move to the second filter portion 131*b* by the drain pump 120.

The water passed through the first filter portion 131*a* may be secondarily filtered by passing through the second filter portion 131*b* and/or the third filter portion 131*c*. In the third filter portion 131*c*, foreign materials separated from the second filter portion 131*b* by the filter blade 136 may be collected. The second filter portion 131*b* and the third filter portion 131*c* may include a mesh filter. The second filter portion 131*b* and/or the third filter portion 131*c* may filter foreign materials having relatively small sizes. The second filter portion 131*b* and/or the third filter portion 131*c* may filter foreign materials having relatively smaller sizes than those of foreign materials that the first filter portion 131*a* may filter.

The first filter portion 131*a*, the second filter portion 131*b*, and the third filter portion 131*c* may be positioned sequentially along a direction in which water flows.

Referring to FIGS. 3 to 6, while the circulation pump 110 operates, water entered the pump device 100 through the inlet 106 may be filtered by passing through the first filter portion 131*a*, and then discharged to the outside of the pump device 100 through the circulation opening 107.

While the drain pump 120 operates, water entered the pump device 100 through the inlet 106 may be primarily filtered in the first filter portion 131*a*.

The water primarily filtered in the first filter portion 131*a* may move to the second filter portion 131*b*. The water secondarily filtered by passing through the second filter portion 131*b* may pass through the third filter portion 131*c*. Water not filtered while passing through the second filter portion 131*b* may be filtered in the third filter portion 131*c*. The water passed through the filter 131 may be discharged to outside of the pump device 100 through the drain opening 108.

The filter 131 may include a blade installing portion 133 in which the filter blade 135 is installed. The blade installing portion 133 may be positioned in the other end of the filter 131, the other end being opposite to one end of the filter 131 in which a filter handle 134 is positioned.

The filter 131 may include the filter handle 134. The filter handle 134 may be exposed to outside of the case 101 in a state in which the filter 131 is installed in the case 101. A user may separate the filter 131 from the case 101 by using the filter handle 134.

The filter blade 136 may be rotatably provided inside the filter 131. The filter blade 136 may include a blade wing 136*a*. The blade wing 136*a* may be formed in a shape of a spiral extending in a radial direction from a rotation shaft of the filter blade 136 along a rotation axis direction (that is, the X-axis direction) of the filter blade 136. The blade wing 136*a* may correspond to the second filter portion 131*b*. The blade wing 136*a* may remove foreign materials collected on an inner surface of the filter 131 by scraping out the foreign materials according to a rotation of the filter blade 136 inside the filter 131. The blade wing 136*a* may include a relatively flexible material.

The filter device 130 may include a blade supporting portion 137 rotatably supporting the filter blade 136. The blade supporting portion 137 may be fixed to the filter 131. The blade supporting portion 137 may be installed in the blade installing portion 133.

The blade supporting portion 137 may include an accommodation guide 137*a* formed at a portion in a circumferential direction. The accommodation guide 137*a* may be in a shape of a groove. A blade guide 146 provided in a driving bracket 143 may be accommodated in the accommodation guide 137*a*. Upon installing of the filter device 130 in the case 101 in a state in which the filter driver 140 is installed in the second case 101*b*, the accommodation guide 137*a* may be arranged to accommodate the blade guide 146. Upon installing of the filter device 130 in the case 101, the accommodation guide 137*a* of the filter device 130 may be guided by the blade guide 146 of the filter driver 140. Accordingly, the filter device 130 may be installed at a correct location in the case 101.

A filter guide 102 for guiding installation of the filter device 130 may be formed inside the second case 101*b* of the case 101. The filter guide 102 may protrude from an inner surface of the second case 101*b*. The filter guide 102 may be inclined in such a way as to further protrude toward inside of the case 101 along a direction in which the filter device 130 is installed. Accordingly, the filter device 130 may be guided to the correct location while being inserted into the inside of the case 101.

The filter device 130 may include a filter gear 138 coupled to the other end of the filter device 130, the other end being opposite to one end of the filter device 130 at which the blade wing 136*a* of the filter blade 136 is positioned. The filter gear 138 may be fixed to the filter blade 136. The filter gear 138 may be engaged with a driving gear 142. The filter gear 138 may have a rotation axis in the X-axis direction. The rotation axis of the filter gear 138 may be identical to the rotation axis of the drain pump motor 121. The filter gear 138 may be a bevel gear.

The pump device 100 may include the filter driver 140 for driving the filter device 130. The filter driver 140 may be installed in the case 101. The filter driver 140 may be installed in the second case 101*b*. The filter driver 140 may include a blade motor 141, the driving gear 142, and the driving bracket 143.

The blade motor 141 may generate power for rotating the filter blade 136. The blade motor 141 may generate a rotation force along an axis extending in the Z-axis direction. The blade motor 141 may be closer to the drain pump 120 than the circulation pump 110. The blade motor 141 may be adjacent to the drain opening 108.

The driving gear 142 may rotate in the Z-axis direction by receiving a rotation force from the blade motor 141. A rotation axis (being parallel to the Z-axis direction) of the driving gear 142 may be different from the rotation axis (being parallel to the X-axis direction) of the drain pump motor 121. The driving gear 142 may be a bevel gear.

The rotation axis of the filter gear 138 coupled to the filter blade 136 may extend along the X-axis direction, and the rotation axis of the driving gear 142 of the filter driver 140 may extend along the Z-axis direction. The rotation axis of the filter gear 138 may form a preset angle with respect to the rotation axis of the driving gear 142. The rotation axis of the filter gear 138 may be perpendicular to the rotation axis of the driving gear 142.

The driving bracket 143 may be fixed to the case 101. The blade guide 146 may be provided in the driving bracket 143.

Referring to FIG. 6, the pump device 100 may include a filtering flow path 171 that passes through the second filter portion 131*b* and/or the third filter portion 131*c*, and a bypass flow path 172 that does not pass through the second filter portion 131*b* and/or the third filter portion 131*c*. The filtering flow path 171 and the bypass flow path 172 may be provided as a portion of a drain flow path connecting the inlet 106 with the drain opening 108. A portion of the filtering flow path 171 may overlap the bypass flow path 172.

The filtering flow path 171 may be defined as a flow path along which water entered the inlet 106 passes through the second filter portion 131*b* and/or the third filter portion 131*c* to be filtered and then moves toward the drain opening 108. The filtering flow path 171 may be defined as a flow path along which water passed through the first filter portion 131*a* passes through the second filter portion 131*b* and/or the third filter portion 131*c* to be filtered and then moves toward the drain opening 108. The filtering flow path 171 may pass through inside of the second filter portion 131*b* and/or the third filter portion 131*c* of the filter 131.

The bypass flow path 172 may be defined as a flow path along which water entered the inlet 106 bypasses the second filter portion 131*b* and/or the third filter portion 131*c* without passing through the second filter portion 131*b* and/or the third filter portion 131*c* and moves toward the drain opening 108. The bypass flow path 172 may be defined as a flow path along which water passed through the first filter portion 131*a* bypasses the second filter portion 131*b* and/or the third filter portion 131*c* without passing through the second filter portion 131*b* and/or the third filter portion 131*c* and moves toward the drain opening 108. The bypass flow path 172 may pass through a space between an outer circumferential surface of the filter 131 and an inner circumferential surface of the case 101 without passing through the inside of the second filter portion 131*b* and/or the third filter portion 131*c*.

Referring to FIGS. 3 and 4, the pump device 100 may include a flow path switching device 160 installed in the case 101. The flow path switching device 160 may guide water entered the case 101 to the filtering flow path 171 or the bypass flow path 172. The flow path switching device 160 may guide water passed through the first filter portion 131*a* to the filtering flow path 171 or the bypass flow path 172. The flow path switching device 160 may be adjacent to a location at which the filtering flow path 171 and the bypass flow path 172 diverge.

The case 101 may include a bypass inlet 103 for communicating with the flow path switching device 160, and a bypass connecting opening 104. The bypass inlet 103 may face the first filter portion 131*a*. The bypass connecting opening 104 may face the second filter portion 131*b*. The flow path switching device 160 may be connected with the inside of the case 101 through the bypass inlet 103 and the bypass connecting opening 104.

Figure 7:
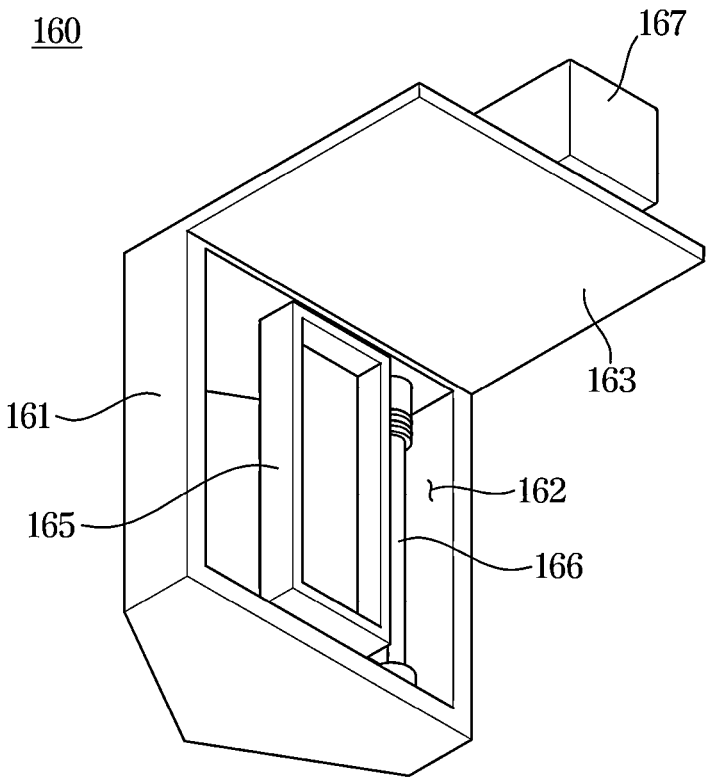
FIG. 7 shows a flow path switching device shown in FIG. 3.
Figure 8:
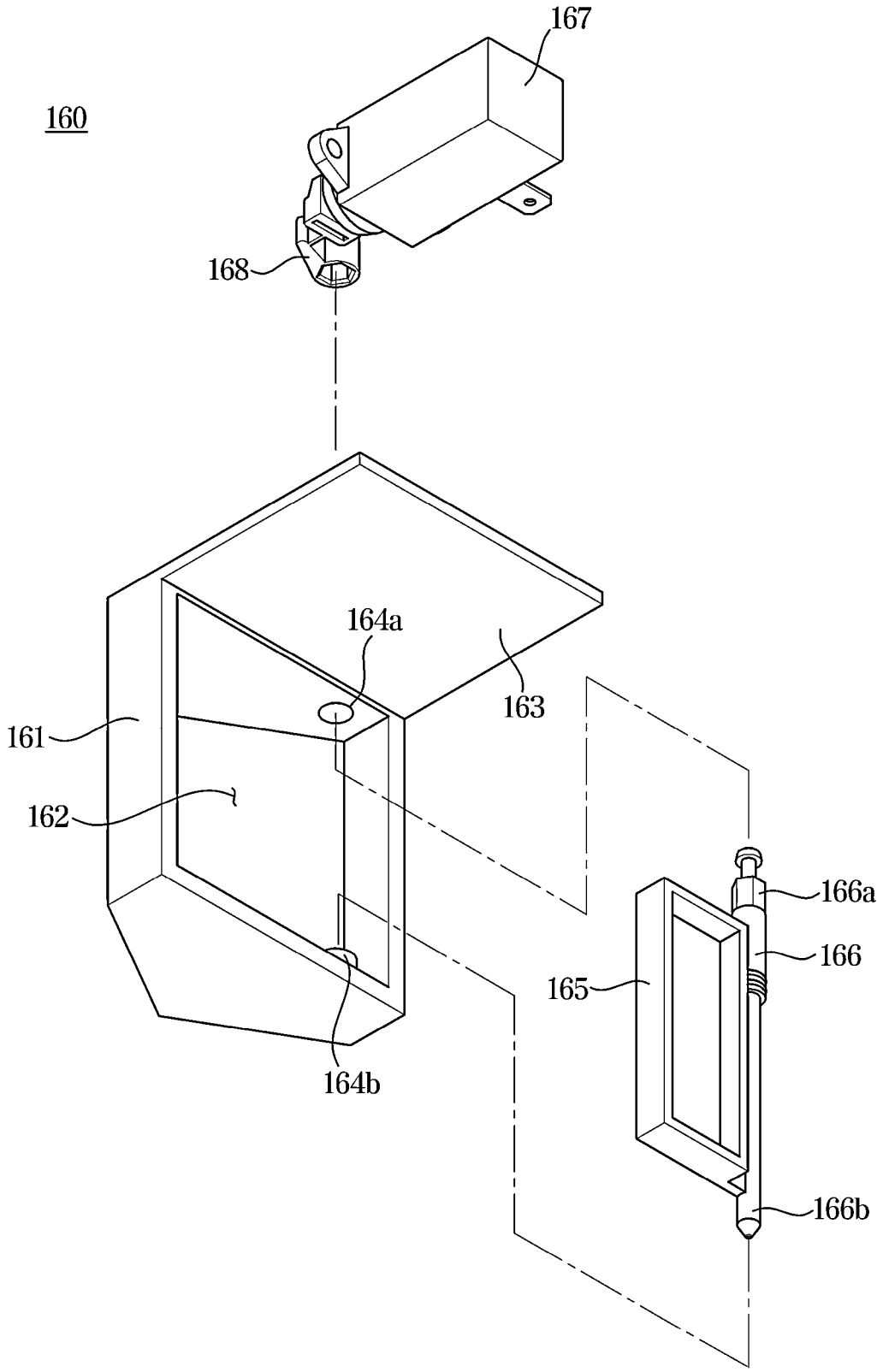
FIG. 8 is an exploded view of the flow path switching device shown in FIG. 7.
Figure 9:
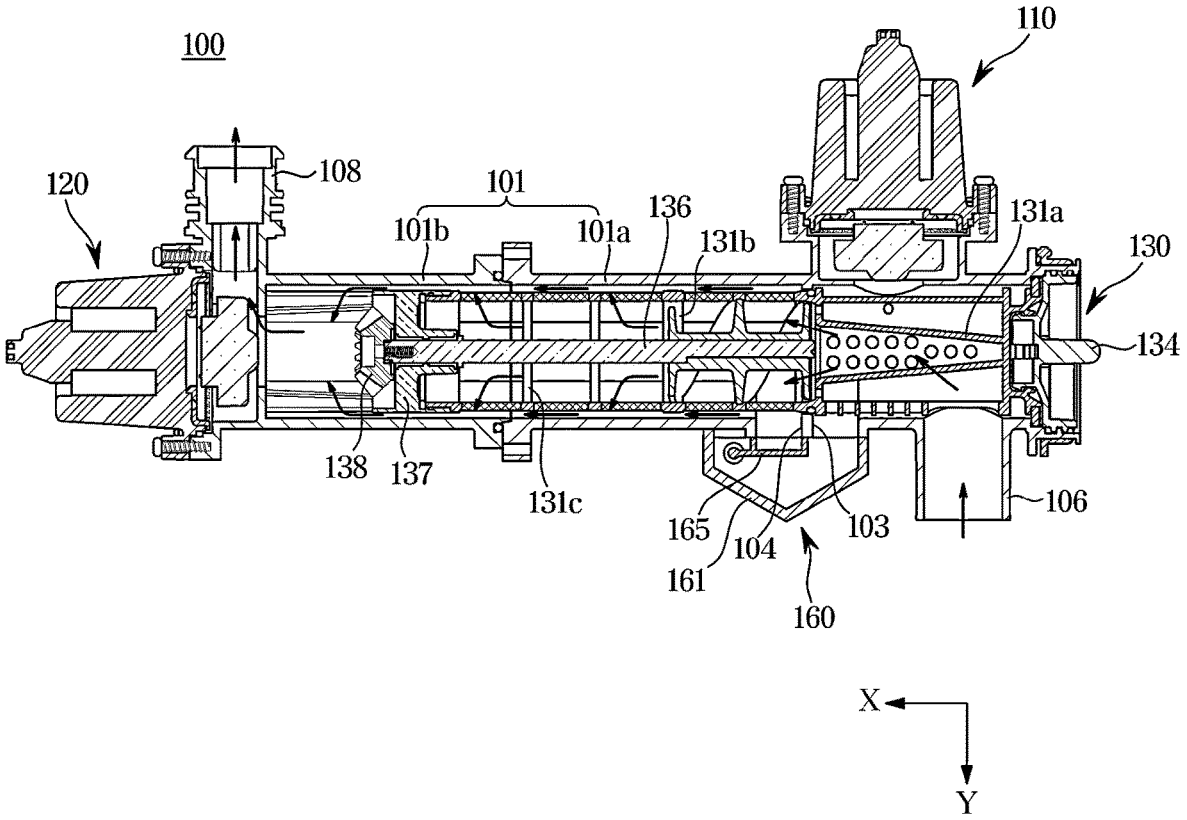
FIG. 9 shows a flow of water received through an inlet in a cross section of the pump device shown in FIG. 3, taken along an X-Y plane.
Figure 10:
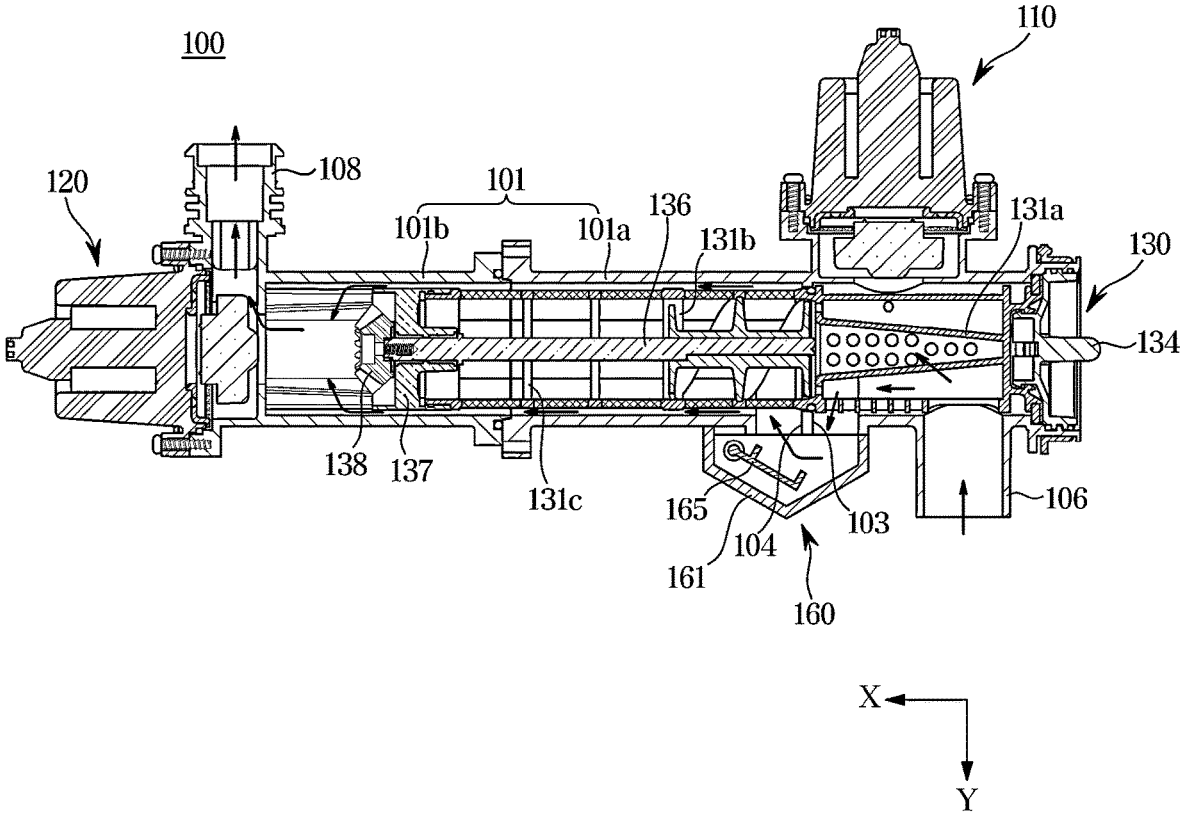
FIG. 10 shows a flow of water received through the inlet in a state in which a portion of a filter shown in FIG. 9 is clogged.

FIG. 7 shows a flow path switching device shown in FIG. 3. FIG. 8 is an exploded view of the flow path switching device shown in FIG. 7. FIG. 9 shows a flow of water received through an inlet in a cross section of the pump device shown in FIG. 3, taken along an X-Y plane. FIG. 10 shows a flow of water received through the inlet in a state in which a portion of a filter shown in FIG. 9 is clogged.

Referring to FIGS. 7 to 9, the flow path switching device 160 according to various embodiments of the disclosure may include a bypass body 161. The bypass body 161 may be installed in the case 101. The bypass body 161 may have a shape surrounding at least one portion of an outer circumferential surface of the case 101.

The bypass body 161 may rotatably support a bypass door 165. A bypass driver 167 may be installed on the bypass body 161. The bypass body 161 may guide water received through the bypass inlet 103 to the bypass connecting opening 104.

The bypass body 161 may include a bypass opening 162 connected with the bypass inlet 103 and the bypass connecting opening 104. The bypass opening 162 may face the bypass inlet 103 and the bypass connecting opening 104.

The bypass body 161 may include a driver installing portion 163 on which the bypass driver 167 is installed. The driver installing portion 163 may extend along the outer circumferential surface of the case 101.

The bypass body 161 may include a plurality of door supporting portions 164*a* and 164*b* for rotatably supporting the bypass door 165. The door supporting portions 164*a* and 164*b* may include a first door supporting portion 164*a* positioned adjacent to the bypass driver 167, and a second door supporting portion 164*b* positioned to face the first door supporting portion 164*a*. The door supporting portions 164*a* and 164*b* may be coupled to both ends of a door shaft 166.

The flow path switching device 160 may include a bypass door 165 rotatably installed in the bypass body 161. The bypass door 165 may open and close the bypass flow path 172. The bypass door 165 may correspond to the bypass connecting opening 104. The bypass door 165 may open and close the bypass connecting opening 104. The bypass door 165 may be adjacent to a location at which the first filter portion 131*a* is connected with the second filter portion 131*b*. The bypass door 165 may rotate by receiving power from the bypass driver 167. The bypass door 165 may include a sealing member provided at a portion facing the bypass connecting opening 104.

The bypass door 165 may include the door shaft 166. One end of the door shaft 166 may be rotatably inserted in the first door supporting portion 164*a*. The other end 166*b* of the door shaft 166, which is opposite to the one end 166*a* of the door shaft 166, may be rotatably inserted in the second door supporting portion 164*b*. The door shaft 166 may be rotatably supported by the door supporting portions 164*a* and 164*b*. Because the door shaft 166 is rotatably supported by the door supporting portions 164*a* and 164*b*, the bypass door 165 may rotate with respect to the bypass body 161.

One end 166*a* of the door shaft 166 may be connected with a power transfer portion 168 of the bypass driver 167 to receive power from the bypass driver 167. At least one portion of the one end 166*a* of the door shaft 166 may have a polyprismatic shape to receive a rotation force from the bypass driver 167. The one end 166*a* of the door shaft 166 may have a shape corresponding to a shape of the power transfer portion 168. The other end 166*b* of the door shaft 166 may have a cylindrical shape, unlike the one end 166*a* of the door shaft 166.

The flow path switching device 160 may include the bypass driver 167 for operating the bypass door 164. The bypass driver 167 may be installed in the bypass body 161. The bypass driver 167 may be installed in the driver installing portion 163.

The bypass driver 167 may be installed in the case 101.

The bypass driver 167 may include a driving source. The driving source may be a motor. The bypass driver 167 may generate power for operating the bypass door 164. The bypass driver 167 may generate a rotation force for rotating the bypass door 154.

The flow path switching device 160 may include the power transfer portion 168 connected with the door shaft 166. The power transfer portion 168 may be coupled to the one end 166*a* of the door shaft 166. The power transfer portion 168 may have a shape corresponding to the polyprismatic shape of the one end 166*a* of the door shaft 166. Because the power transfer portion 168 is provided as a shape corresponding to the polyprismatic shape of the one end 166*a* of the door shaft 166, the bypass door 165 may receive power from the bypass driver 167. Because the power transfer portion 168 is provided as a shape corresponding to the polyprismatic shape of the one end 166*a* of the door shaft 166, the bypass door 165 may receive a rotation force from the bypass driver 167.

Referring to FIG. 9, in a state in which the second filter portion 131*b* is not clogged, the flow path switching device 160 may close the bypass flow path 172. The bypass door 165 may close the bypass connecting opening 104. According to closing of the bypass flow path 172, water entered the inlet 106 may be filtered in the first filter portion 131*a* and then move along the filtering flow path 171. The water filtered in the first filter portion 131*a* may be filtered by passing through the second filter portion 131*b* and/or the third filter portion 131*c* of the filter 131. The water filtered by passing through the second filter portion 131*b* and/or the third filter portion 131*c* may be discharged from the pump device 100 through the drain opening 108.

As water entered the inlet 106 passes through the first filter portion 131*a* and then passes through the second filter portion 131*b* and/or the third filter portion 131*c*, filtered foreign materials may be accumulated in the second filter portion 131*b* and/or the third filter portion 131*c*. The filter blade 136 may move foreign materials collected on the inner circumferential surface of the second filter portion 131*b* to the third filter portion 131*c*. Accordingly, a time for which the second filter portion 131*b* is capable of filtering foreign materials may increase, and a replacement cycle of the filter 131 may increase.

The third filter portion 131*c* may be clogged according to accumulation of foreign materials collected in the third filter portion 131*c* and foreign materials moved from the second filter portion 136*b* by the filter blade 136. In a state in which the third filter portion 131*c* is clogged, water passed through the first filter portion 131*a* may pass through the second filter portion 131*b*, and foreign materials of the water may be filtered. Accordingly, the second filter portion 131*b* may be clogged.

Referring to FIG. 10, in a state in which the second filter portion 131*b* is clogged, the flow path switching device 160 may open the bypass flow path 172. The bypass door 165 may open the bypass connecting opening 104. According to opening of the bypass flow path 172, water entered the inlet 106 may be filtered in the first filter portion 131*a*, and then move along the bypass flow path 172. The water passed through the first filter portion 131*a* may enter inside of the bypass body 161 through the bypass inlet 103, and then move to the space between the inner circumference surface of the case 101 and the outer circumferential surface of the filter 131 through the bypass connecting opening 104. The water moved to the space between the case 101 and the filter 131 may be discharged from the pump device 100 through the drain opening 108.

According to the configuration, the washing machine 1 according to various embodiments of the disclosure may discharge water from the pump device 100 although a portion of the filter 131 of the pump device 100 is clogged, and accordingly, the washing machine 1 may be prevented from stopping.

FIG. 11 is a block diagram briefly showing components of a washing machine according to an embodiment of the disclosure and a flow of signals between the components.

A method for controlling the flow path switching device 160 of the pump device 100 shown in FIGS. 3 to 10 will be described with reference to FIG. 11.

Referring to FIG. 11, the washing machine 1 according to an embodiment of the disclosure may include the control panel 14 for interworking with a user, the water supply 60, the filter driver 140, the driving motor 51, the circulation pump 110, the drain pump 120, the flow path switching device 160, a communicator 95, and the controller 90 for controlling various components of the washing machine 1.

The control panel 14 may include the inputter 14*a* and the display 14*b*, and operate based on a control signal from the controller 90.

The water supply 60 may provide water supplied from an external water supply source to the inside of the tub 20 based on a control signal from the controller 90.

For this, the water supply 60 may include at least one water supply valve.

The at least one water supply valve may include a water supply valve for supplying water supplied from the external water supply source to the detergent supply device 70, and/or a water supply valve for supplying water supplied from the external water supply source directly to the tub 20.

The driving motor 51 may rotate the drum 30. For this, although not shown in the drawings, the controller 90 may control a driving circuit for applying driving current to the driving motor 51.

The driving circuit may supply driving current to the driving motor 51 in response to a driving signal from the controller 90.

According to an embodiment of the disclosure, the driving circuit may include a rectifier circuit for rectifying alternating current power of an external power source, a direct current link circuit for removing ripples from the rectified power and outputting direct current power, an inverter circuit for converting the direct current power into driving power in a sinusoidal form and outputting the driving current to the driving motor 51, a current sensor for measuring driving current that is supplied to the driving motor 51, and a gate driver for turning on/off a switching device included in the inverter circuit based on a driving signal from the controller 90.

The filter driver 140 may include the filter blade 136 that is slidably and rotatably inserted onto the inner surface of the filter 131, and the blade motor 141 for rotating the filter blade 136.

The controller 90 may control the filter driver 140.

According to an embodiment of the disclosure, the controller 90 may control a driving circuit for applying driving current to the blade motor 141. The driving circuit may supply driving current to the blade motor 141 in response to a driving signal from the controller 90. A configuration of the driving circuit connected with the blade motor 141 may be the same as or different from a configuration of the driving circuit connected with the driving motor 51. For example, the driving circuit connected with the driving motor 51 may include a current sensor for measuring current applied to the driving motor 51.

The driving circuit connected with the blade motor 141 may include components for driving a DC motor, unlike the driving circuit connected with the driving motor 51.

The pump device 100 may include the circulation pump 110 and the drain pump 120.

The controller 90 may drive the circulation pump 110 to perform a circulation operation, and drive the drain pump 120 to perform a drain operation.

The flow path switching device 160 may selectively guide water entered the case 101 to the filtering flow path 171 or the bypass flow path 172.

The controller 90 may control the flow path switching device 160 to guide water entered the case 101 to the filtering flow path 171 based on an identification that a first preset condition is satisfied.

Also, the controller 90 may control the flow path switching device 160 to guide water entered the case 101 to the bypass flow path 172 based on an identification that a second preset condition is satisfied.

The communicator 95 may transmit data to an external device based on a control signal from the controller 90, or receive data from an external device. For example, the communicator 95 may transmit and receive various data by communicating with a server, and/or a user terminal, and/or a home appliance.

For this, the communicator 95 may establish a direct (wired) communication channel or a wireless communication channel with an external electronic device (for example, a server, a user terminal, and/or a home appliance), and support communication through the established communication channel. According to an embodiment of the disclosure, the communicator 95 may include a wireless communication module (for example, a cellular communication module, a short-range wireless communication module, or a global navigation satellite system (GNSS) communication module), or a wired communication module (for example, a local area network (LAN) communication module or a power line communication module). A corresponding communication module among the communication modules may communicate with an external electronic device through a first network (for example, a short-range communication network, such as Bluetooth, wireless fidelity (WiFi) direct, or infrared data association (IrDA)) or a second network (for example, a telecommunication network, such as a legacy cellular network, a 5G network, a next-generation communication network, internet, or a computer network (for example, a local area network (LAN) or a wide area network (WAN)). Such various kinds of communication modules may be integrated into a component (for example, a single chip) or implemented as a plurality of independent components (for example, a plurality of chips).

According to various embodiments of the disclosure, the communicator 95 may establish communication with a user terminal through a server.

According to various embodiments of the disclosure, the communicator 95 may include a WiFi module, and may perform communication with an external server and/or a user terminal based on communication establishment with an Access Point (AP) in home.

The controller 90 may include at least one memory 92 and at least one processor 91 to perform the above-described operations and operations which will be described below.

According to an embodiment of the disclosure, the controller 90 may include at least one memory 92 that stores data in a form of an algorithm and/or program for controlling operations of components in the washing machine 1, and at least one processor 91 that performs the above-described operations and operations which will be described below by using the data stored in the at least one memory 92. The memory 92 and the processor 91 may be implemented as separate chips. The processor 91 may include one, two or more processor chips or one, two, or more processing cores. The memory 92 may include one, two, or more memory chips or one, two, or more memory blocks. Also, the memory 92 and the processor 91 may be implemented as a single chip.

The controller 90 may process a user input received through the inputter 14*a*, and control various components (for example, the driving motor 51, the water supply 60, the display 14*b*, the filter driver 140, the circulation pump 110, the drain pump 120, and the flow path switching device 160) of the washing machine 1 based on a result of the processing on the user input.

Hereinafter, a description about overlapping components in FIG. 12, 14, or 16 will be omitted.

As described above, the controller 90 may control the flow path switching device 160 to guide water entered the case 101 to the filtering flow path 171 based on an identification that the first preset condition is satisfied, and control the flow path switching device 160 to guide water entered the case 101 to the bypass flow path 172 based on an identification that the second preset condition is satisfied.

Herein, the first preset condition and the second preset condition may be information about a state of the filter 131. For example, the first preset condition may be a condition that clogging of the filter 131 is not detected, and the second preset condition may be a condition that clogging of the filter 131 is detected.

According to an embodiment of the disclosure, a current sensor for detecting a value of driving current applied to the blade motor 141 may be an example of a sensor for obtaining information about a state of the filter 131.

While the controller 90 operates the filter driver 140, the controller 90 may identify whether the filter 131 is clogged based on a value of driving current applied to the blade motor 141. That is, while the controller 90 drives the blade motor 141, the controller 90 may identify whether the filter 131 is clogged based on a load value of the blade motor 141.

According to an embodiment of the disclosure, the controller 90 may identify that the filter 131 is clogged, based on an identification that a value of driving current applied to the blade motor 141 exceeds a preset value. Also, the controller 90 may identify that the filter 131 is not clogged, based on an identification that a value of driving current applied to the blade motor 141 is within a preset range.

Based on an identification that the filter 131 is clogged, the controller 90 may control the flow path switching device 160 to guide water entered the case 101 to the bypass flow path 172. The flow path switching device 160 may control the bypass door 165 to open the bypass flow path 172 based on a control signal from the controller 90.

Based on an identification that the filter 131 is not clogged, the controller 90 may control the flow path switching device 160 to guide water entered the case 101 to the filtering flow path 171. The flow path switching device 160 may control the bypass door 165 to close the bypass flow path 172 based on a control signal from the controller 90.

According to the current embodiment of the disclosure, the controller 90 may control the bypass door 165 to open the bypass flow path 172 based on an identification that a value of driving current applied to the blade motor 141 exceeds the preset value, and control the bypass door 165 to close the bypass flow path 172 based on an identification that a value of driving current applied to the blade motor 141 is within a preset range that is smaller than or equal to the preset value.

Figure 12A:
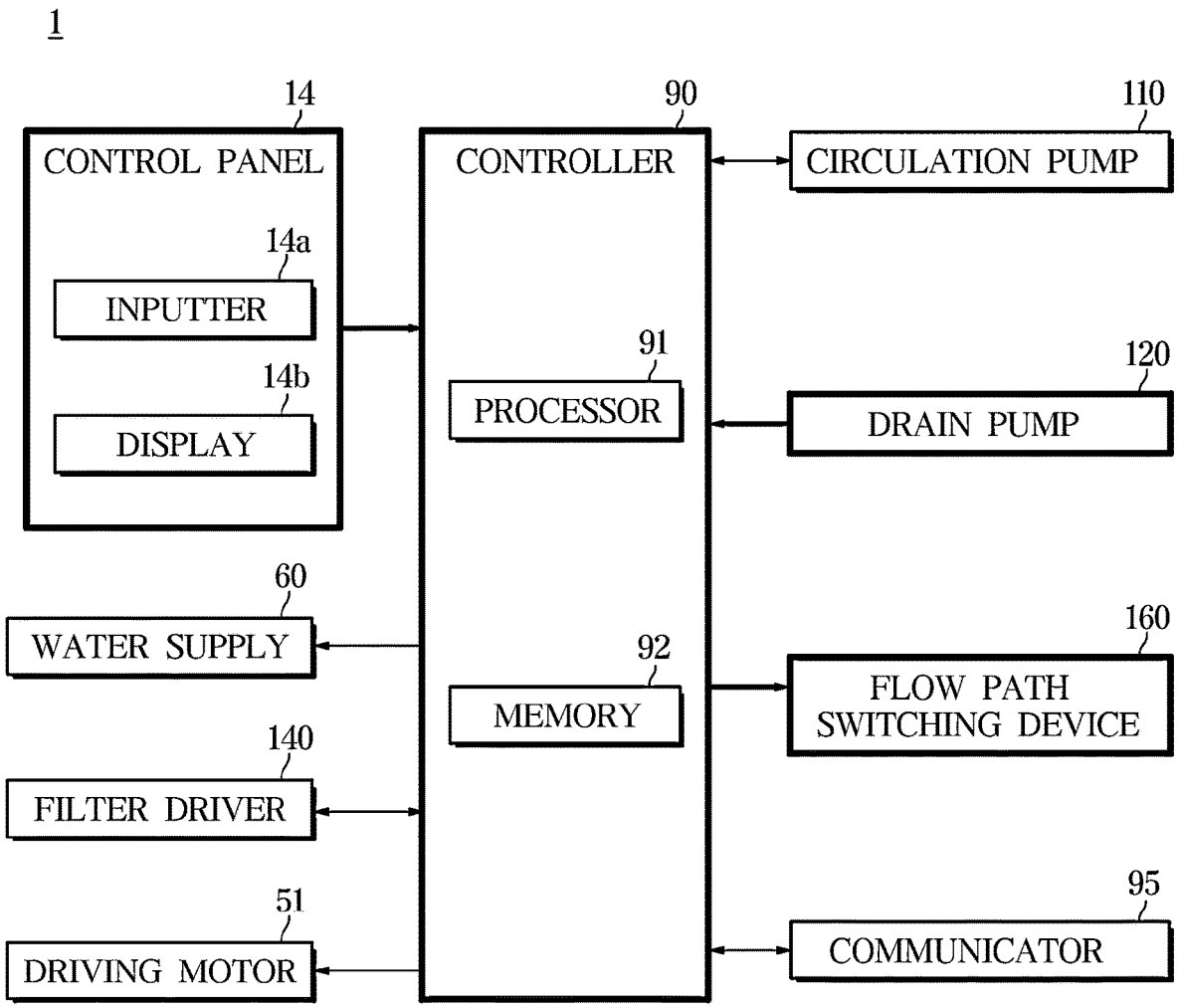
FIG. 12A is a block diagram briefly showing components of a washing machine according to an embodiment of the disclosure and a flow of signals between the components.
Figure 12B:
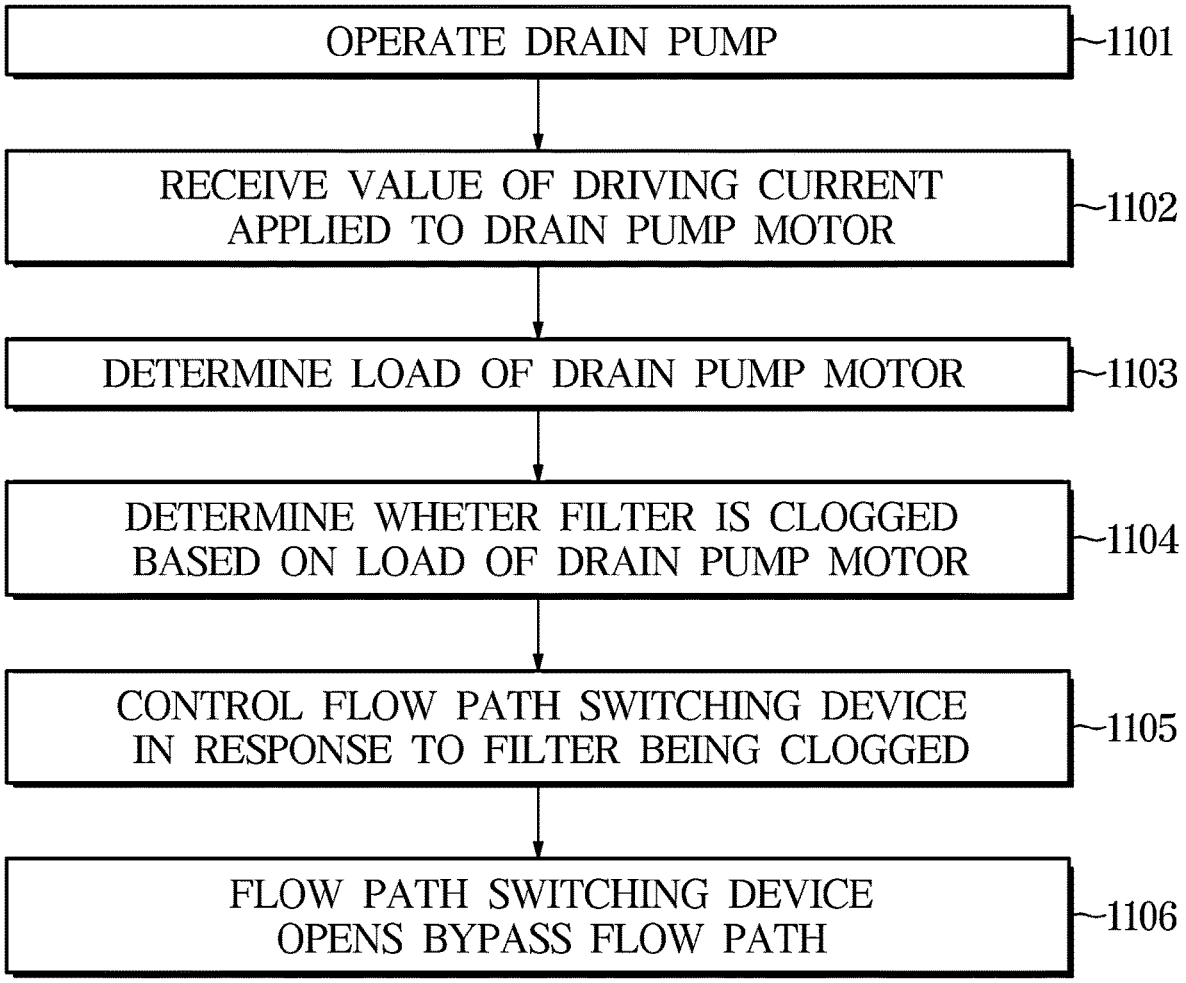
FIG. 12B is a flowchart showing a method for controlling a washing machine, according to an embodiment of the disclosure.
Figure 12C:
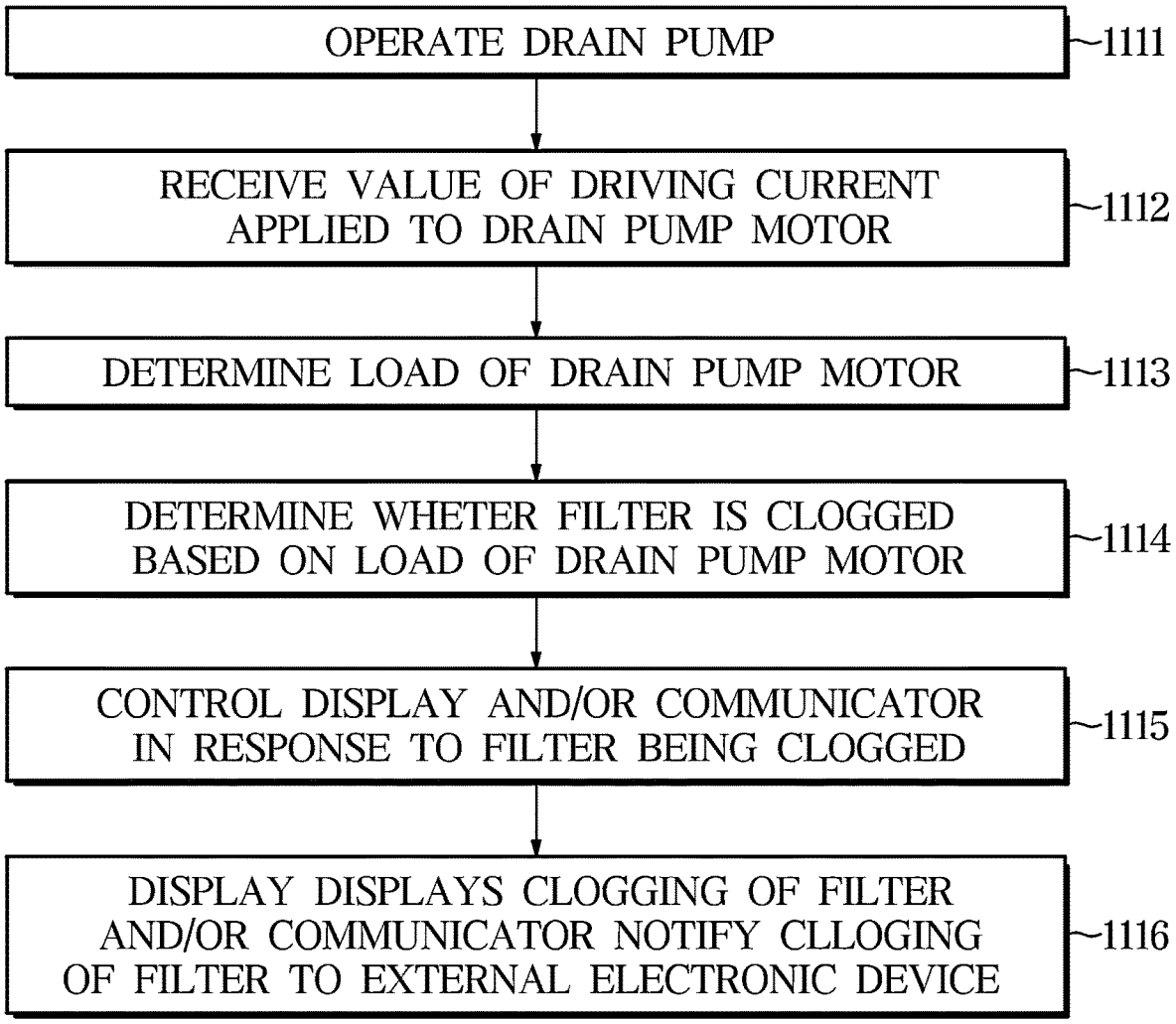
FIG. 12C is a flowchart showing a method for controlling a washing machine, according to an embodiment of the disclosure.

FIG. 12A is a block diagram briefly showing components of a washing machine according to an embodiment of the disclosure and a flow of signals between the components. FIG. 12B is a flowchart showing a method for controlling a washing machine, according to an embodiment of the disclosure. FIG. 12C is a flowchart showing a method for controlling a washing machine, according to an embodiment of the disclosure.

Referring to FIG. 12A, according to an embodiment of the disclosure, a current sensor for detecting a value of driving current applied to the drain pump 120 may be an example of a sensor for obtaining information about a state of the filter 131. The value of the driving current applied to the drain pump 120 may be a value of driving current applied to the drain pump motor 121.

Referring to FIGS. 12A and 12B, the controller 90 may operate the drain pump 120 in response to an operation condition of the drain pump 120 being satisfied (1101). For example, the controller 90 may operate the drain pump 120 in response to drain operation being started. While operating the drain pump 120, the controller 90 may receive a value of driving current applied to the drain pump motor 121 (1102). For example, the controller may receive data and/or information associated with a value of driving current applied to the drain pump motor 121 from a current sensor detecting a value of driving current applied to the drain pump motor 121.

The controller 90 may determine a load of the drain pump motor 121 based on a value of driving current applied to the drain pump motor 121 (1103).

The controller 90 may identify whether the filter 131 is clogged based on the load of the drain pump motor 121 (1104). For example, the controller 90 may identify whether the filter 131 is clogged based on a value of the load of the drain pump motor 121 while operating the drain pump motor 121.

The controller 90 may determine that the filter 131 is clogged in response to the load of the drain pump motor 121 being greater than a preset load. The controller 90 may determine that the filter 131 is not clogged in response to the load of the drain pump motor 121 being smaller than a preset load.

According to various embodiments, the controller 90 may identify that the filter 131 is clogged, based on an identification that a value of driving current applied to the drain pump motor 121 exceeds the preset value. Also, the controller 90 may identify that the filter 131 is not clogged, based on an identification that a value of driving current applied to the drain pump motor 121 is within the preset range.

Based on the identification that the filter 131 is clogged, the controller 90 may control the flow path switching device 160 to guide water entered the case 101 to the bypass flow path 172 (1105). The flow path switching device 160 may control the bypass door 165 to open the bypass flow path 172 based on a control signal from the controller 90 (1106).

Based on the identification that the filter 131 is not clogged, the controller 90 may control the flow path switching device 160 to guide water entered the case 101 to the filtering flow path 171. The flow path switching device 160 may control the bypass door 165 to close the bypass flow path 172 based on a control signal from the controller 90.

According to the current embodiment of the disclosure, the controller 90 may control the bypass door 165 to open the bypass flow path 172 based on an identification that a value of driving current applied to the drain pump motor 121 exceeds the preset value, and based on an identification that a value of driving current applied to the drain pump motor 121 is within the preset range that is smaller than or equal to the preset value, the controller 90 may control the bypass door 165 to close the bypass flow path 172.

Referring to FIGS. 12A and 12C, the controller 90 may operate the drain pump 120 in response to an operation condition of the drain pump 120 being satisfied (1111). For example, the controller 90 may operate the drain pump 120 in response to drain operation being started. While operating the drain pump 120, the controller 90 may receive a value of driving current applied to the drain pump motor 121 (1112). For example, the controller may receive data and/or information associated with a value of driving current applied to the drain pump motor 121 from a current sensor detecting a value of driving current applied to the drain pump motor 121.

The controller 90 may determine a load of the drain pump motor 121 based on a value of driving current applied to the drain pump motor 121 (1113).

The controller 90 may identify whether the filter 131 is clogged based on the load of the drain pump motor 121 (1114). For example, the controller 90 may identify whether the filter 131 is clogged based on a value of the load of the drain pump motor 121 while operating the drain pump motor 121.

The controller 90 may determine that the filter 131 is clogged in response to the load of the drain pump motor 121 being greater than a preset load. The controller 90 may determine that the filter 131 is not clogged in response to the load of the drain pump motor 121 being smaller than a preset load.

According to various embodiments, the controller 90 may identify that the filter 131 is clogged, based on an identification that a value of driving current applied to the drain pump motor 121 exceeds the preset value. Also, the controller 90 may identify that the filter 131 is not clogged, based on an identification that a value of driving current applied to the drain pump motor 121 is within the preset range.

According to various embodiments, based on the identification that the filter 131 is clogged, the controller 90 may control the display 14*b* to notify clogging of filter 131 (1115). According to various embodiments, based on the identification that the filter 131 is clogged, the controller 90 may control the communicator 95 to transmit a message to external electronic device(s) notifying clogging of filter 131 (1115).

The display 14*b* may output visual indications representing the clogging of filter 131 based on a control signal of the controller 90 (1116). The communicator 95 may transmit a message to external electronic device(s) notifying clogging of filter 131 based on a control signal of the controller 90 (1116).

According to the current embodiment of the disclosure, the controller 90 may control the display 14*b* to output visual indications representing the clogging of filter 131 based on an identification that a value of driving current applied to the drain pump motor 121 exceeds the preset value.

According to the current embodiment of the disclosure, the controller 90 may control the communicator 95 to transmit a message to external electronic device(s) notifying clogging of filter 131 based on an identification that a value of driving current applied to the drain pump motor 121 exceeds the preset value.

Figure 13:
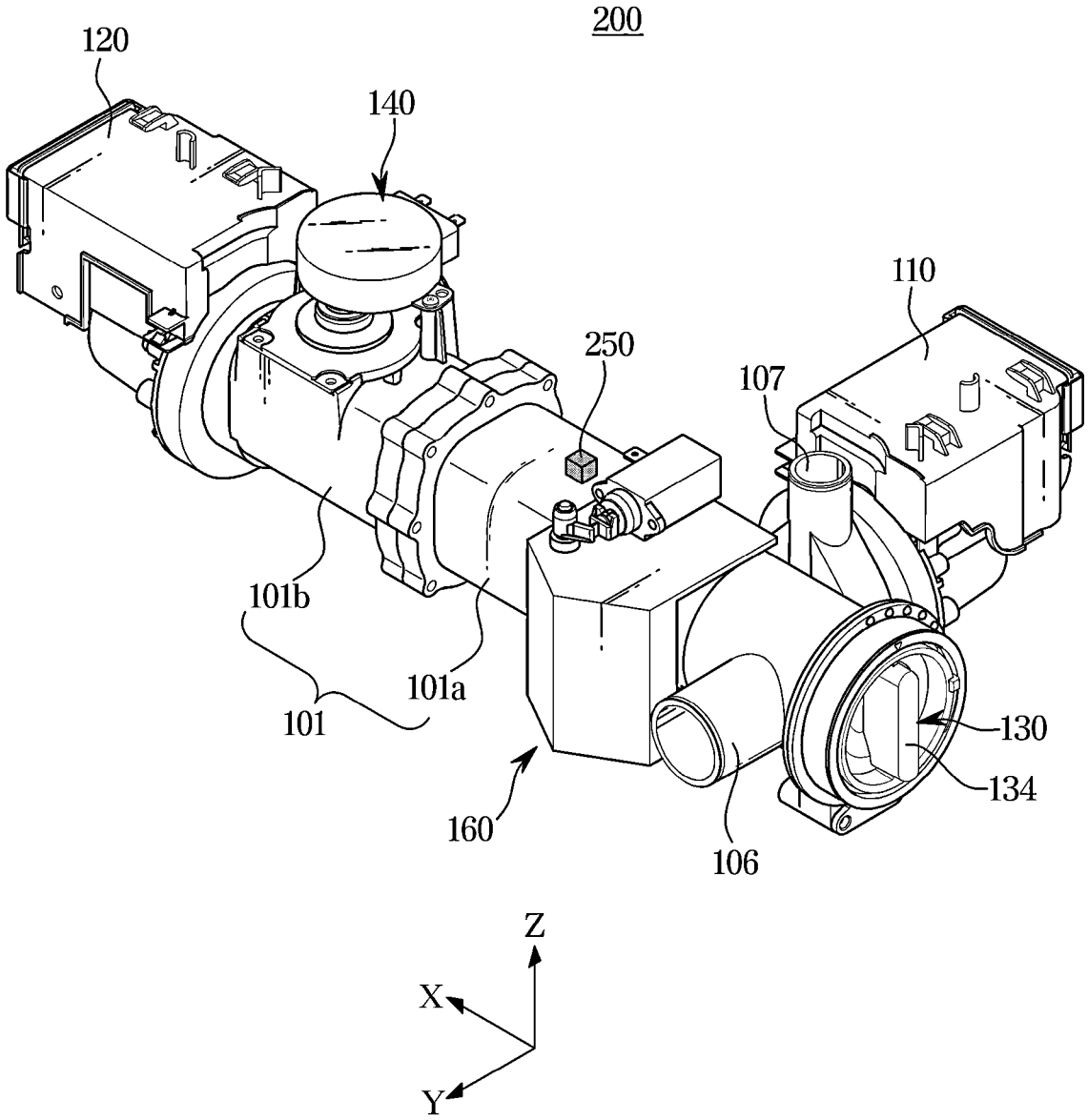
FIG. 13 shows a pump device according to an embodiment of the disclosure.

FIG. 13 shows a pump device according to an embodiment of the disclosure.

Referring to FIG. 13, a pump device according to various embodiments of the disclosure will be described. In the following description about the pump device 200 shown in FIG. 13, the same components as those of the pump device 100 shown in FIGS. 3 to 10 are assigned like reference numerals, and a detailed description thereof will be omitted.

Referring to FIG. 13, the pump device 200 may include the case 101, the circulation pump 110 for circulating water stored in the tub 20, the drain pump 120 for discharging water stored in the tub 20 to the outside of the housing 10, the filter device 130 for filtering water discharged through the drain pump 120, the filter driver 140 for driving the filter device 130, and the flow path switching device 160 for guiding water entered the inside of the case 101 through the inlet 106 to pass through a portion of the filter device 130 or bypass the portion of the filter device 130.

The pump device 200 according to various embodiments of the disclosure may include a sensor 250 for obtaining information about a state of the filter 131. The sensor 250 may identify whether the filter 131 is clogged. The sensor 250 may identify whether the second filter portion 131*b* is clogged.

The sensor 250 may be installed on the case 101. The sensor 250 may be positioned at a location corresponding to the filter 131. The sensor 250 may be positioned at a location corresponding to the second filter portion 131*b*. The sensor 250 may be positioned at a location corresponding to the third filter portion 131*c*. The sensor 250 may include an optical sensor for detecting an amount of foreign materials collected in the filter 131.

Figure 14A:
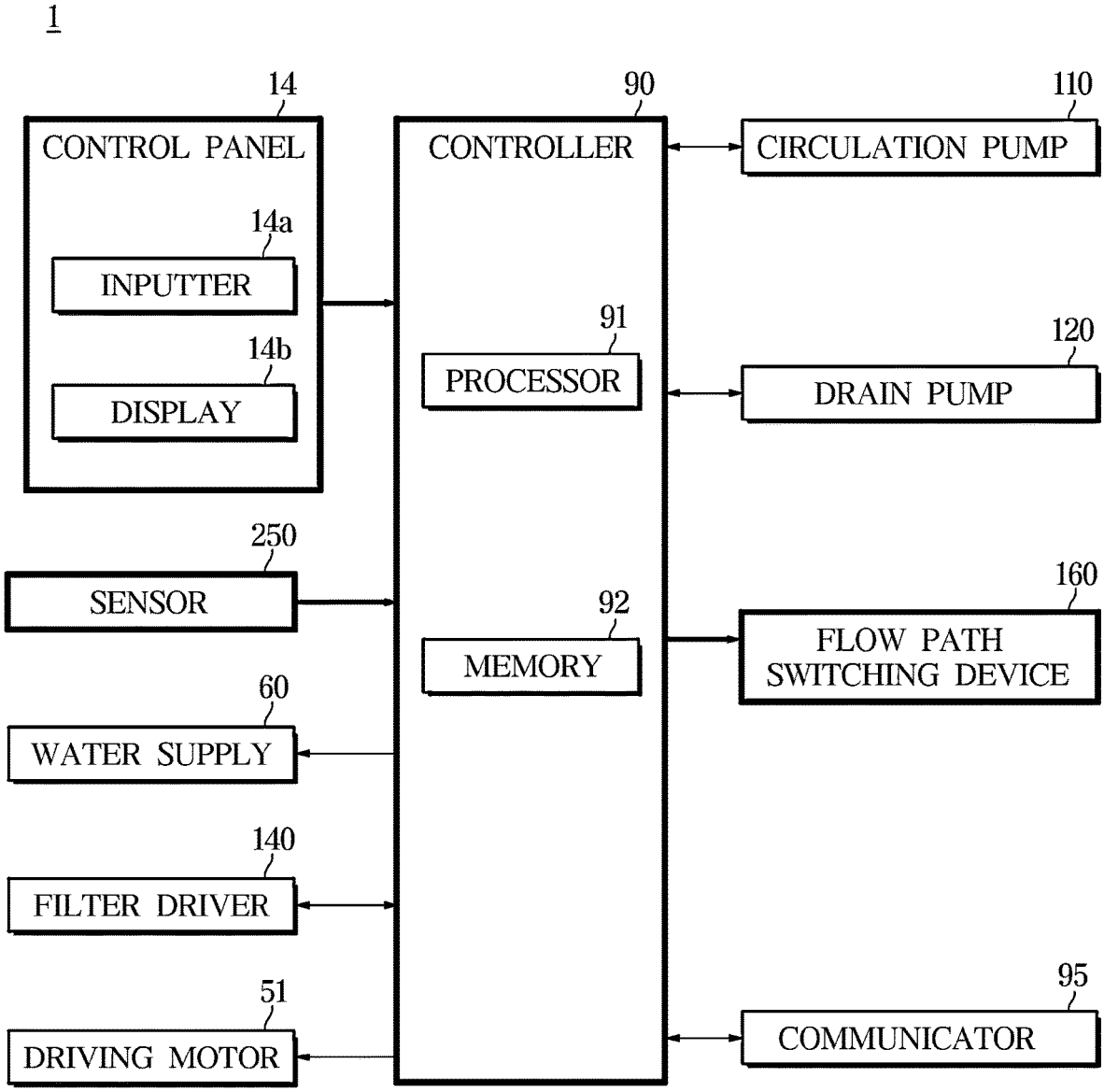
FIG. 14A is a block diagram briefly showing components of a washing machine according to an embodiment of the disclosure and a flow of signals between the components.
Figure 14B:
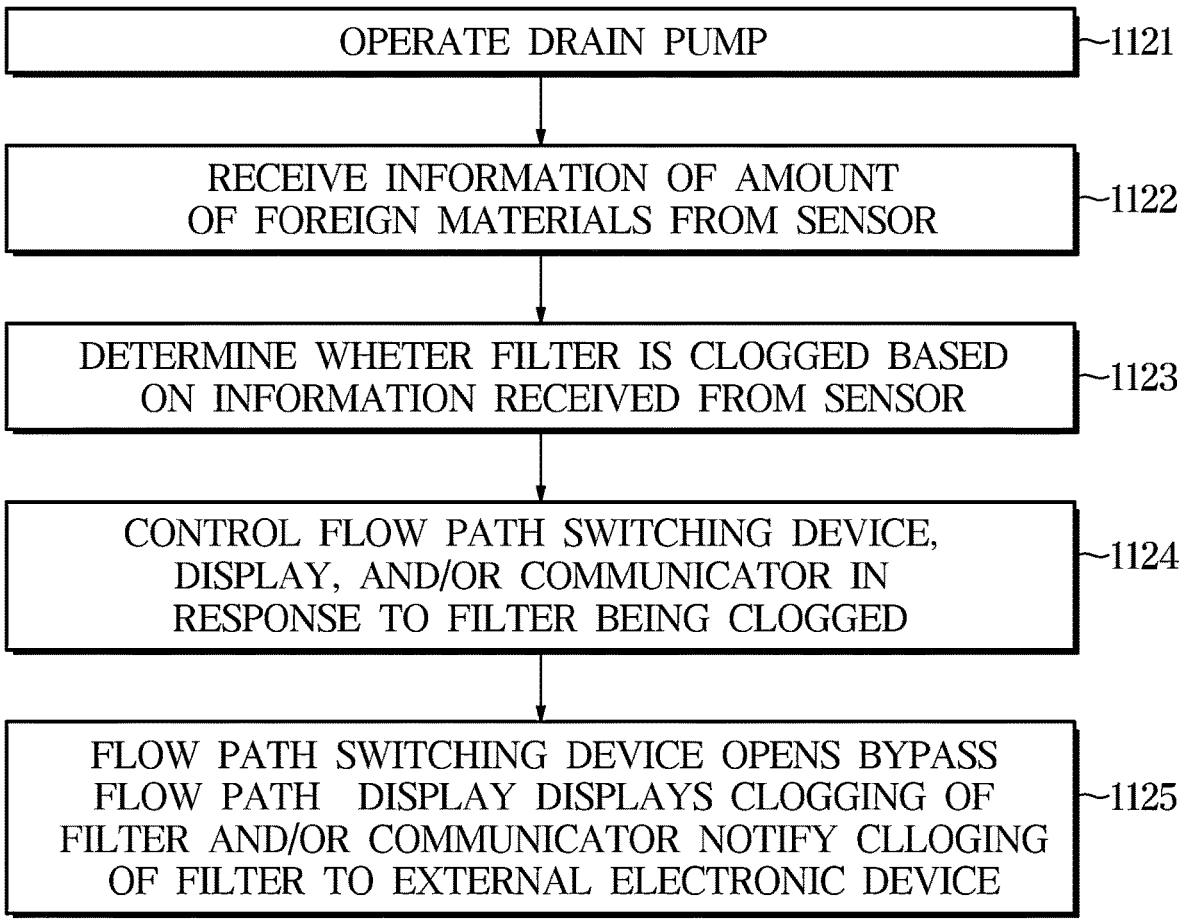
FIG. 14B is a flowchart showing a method for controlling a washing machine, according to an embodiment of the disclosure.

FIG. 14A is a block diagram briefly showing components of a washing machine according to an embodiment of the disclosure and a flow of signals between the components. FIG. 14B is a flowchart showing a method for controlling a washing machine, according to an embodiment of the disclosure.

A method for controlling the flow path switching device 160 of the pump device 200 shown in FIG. 13 will be described with reference to FIGS. 14A and 14B.

Referring to FIG. 14A, the washing machine 1 may further include the sensor 250, in addition to the components shown in FIG. 11.

The sensor 250 may be installed on the case 101, and detect an amount of foreign materials collected in the filter 131.

For example, the sensor 250 may include an optical sensor (for example, an infrared sensor) for detecting an amount of foreign materials collected in the filter 131. However, the sensor 250 is not limited to the optical sensor, and the sensor 250 may be any component capable of detecting an amount of foreign materials collected in the filter 131.

While the controller 90 drives the pump device 100, the controller 90 may operate the sensor 250.

The sensor 250 may identify whether the filter 131 is clogged. For example, the sensor 250 may irradiate light onto the second filter portion 131*b* and/or the third filter portion 131*c*, and receive light reflected from the second filter portion 131*b* and/or the third filter portion 131*c* to detect an amount of foreign materials collected in the second filter portion 131*b* and/or the third filter portion. Information about the amount of foreign materials, obtained from the sensor 250, may be digitized.

Referring to 14B, the controller 90 may operate the drain pump 120 in response to an operation condition of the drain pump 120 being satisfied (1121). For example, the controller 90 may operate the drain pump 120 in response to drain operation being started. While operating the drain pump 120, the controller 90 may receive information of an amount of foreign materials from the sensor 250 (1122). According to the various embodiment, the controller 90 may turn on the sensor 250 in response to operating the drain pump 120. According to the various embodiment, the sensor 250 may transmit a filter clogging detection signal to the controller 90 based on the amount of foreign materials collected in the filter 131 being greater than a preset amount. The filter clogging detection signal may be one example of information of the amount of the foreign materials.

The controller 90 may identify whether the filter 131 is clogged, based on the information obtained from the sensor 250 (1123).

For example, the controller 90 may identify that the filter 131 is clogged, based on an identification that an amount of foreign materials collected in the filter 131 is more than a preset amount, and based on an identification that an amount of foreign materials collected in the filter 131 is less than the preset amount, the controller 90 may identify that the filter 131 is not clogged.

For example, the controller 90 may identify that the filter 131 is clogged in response to receiving the filter clogging detection signal from the sensor 250.

Based on the identification that the filter 131 is clogged, the controller 90 may control the flow path switching device 160 to guide water entered the case 101 to the bypass flow path 172 (1124). The flow path switching device 160 may control the bypass door 165 to open the bypass flow path 172 based on a control signal from the controller 90 (1125).

The controller 90 may control the flow path switching device 160 to guide water entered the case 101 to the filtering flow path 171, based on an identification that the filter 131 is not clogged. The flow path switching device 160 may control the bypass door 165 to close the bypass flow path 172 based on a control signal from the controller 90.

According to various embodiments, based on the identification that the filter 131 is clogged, the controller 90 may control the display 14*b* to notify clogging of filter 131 (1124). According to various embodiments, based on the identification that the filter 131 is clogged, the controller 90 may control the communicator 95 to transmit a message to external electronic device(s) notifying clogging of filter 131 (1124).

The display 14*b* may output visual indications representing the clogging of filter 131 based on a control signal of the controller 90 (1125). The communicator 95 may transmit a message to external electronic device(s) notifying clogging of filter 131 based on a control signal of the controller 90 (1125).

In the current embodiment of the disclosure, the controller 90 may control the bypass door 165 to open the bypass flow path 172 based on a detection that the filter 131 is clogged by the sensor 250, and based on a detection that the filter 131 is not clogged by the sensor 250, the controller 90 may control the bypass door 165 to close the bypass flow path 172.

According to the current embodiment of the disclosure, the controller 90 may control the display 14*b* to output visual indications representing the clogging of filter 131 based on a detection that the filter 131 is clogged by the sensor 250.

According to the current embodiment of the disclosure, the controller 90 may control the communicator 95 to transmit a message to external electronic device(s) notifying clogging of filter 131 based on a detection that the filter 131 is clogged by the sensor 250.

Figure 15:
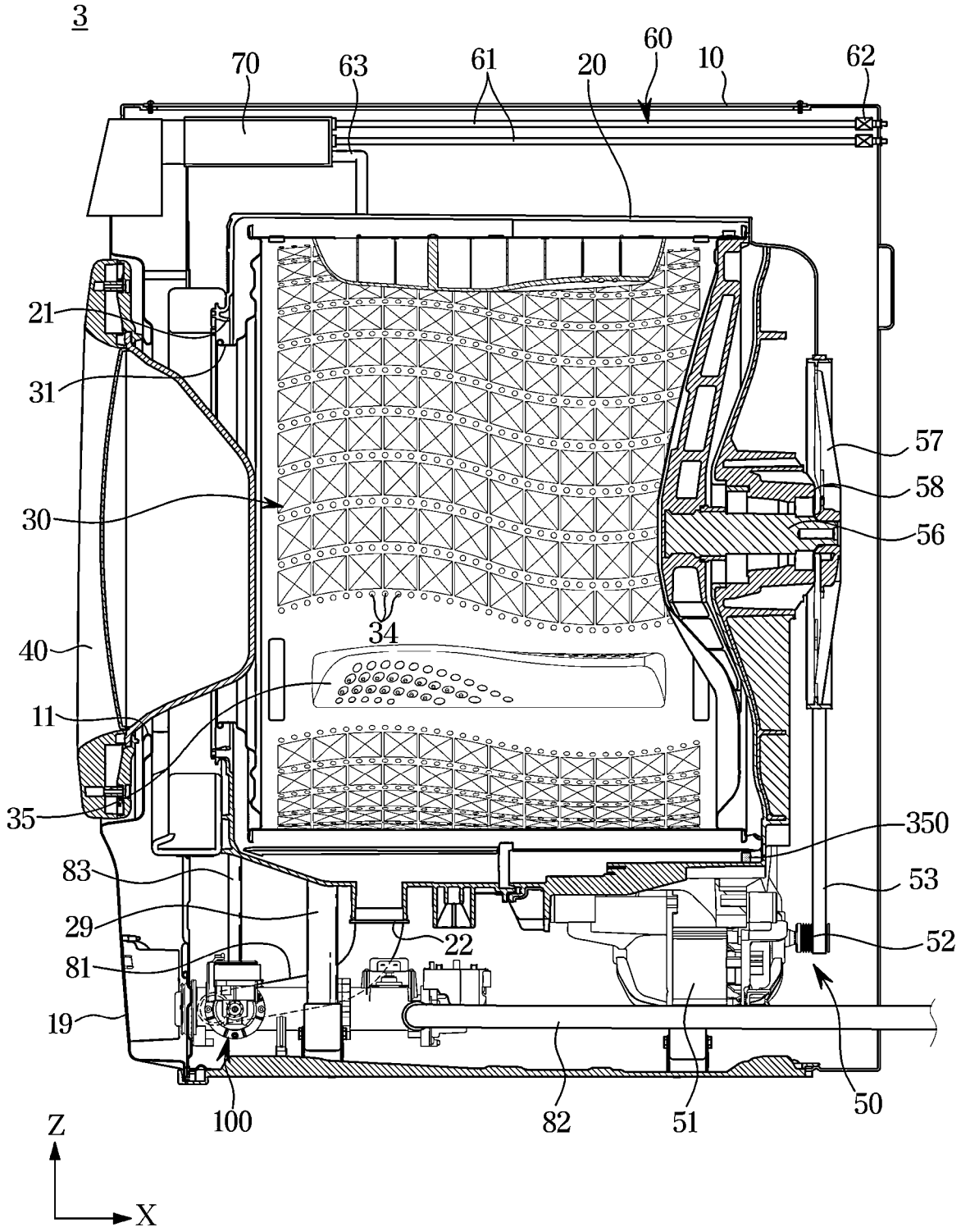
FIG. 15 shows a washing machine according to an embodiment of the disclosure.

FIG. 15 shows a washing machine according to an embodiment of the disclosure.

A washing machine 3 according to various embodiments of the disclosure will be described with reference to FIG. 15. In the following description about the washing machine 3 shown in FIG. 15, the same components as those of the washing machine 1 shown in FIG. 2 are assigned like reference numerals, and a detailed description thereof will be omitted.

Referring to FIG. 15, the washing machine 3 may include the housing 10, the tub 20 positioned inside the housing 10, the drum 30 rotatably provided inside the tub 20, and the pump device 100 configured to drain water stored in the tub 20.

The washing machine 3 according to various embodiments of the disclosure may include a water level sensor 350 capable of detecting a water level of the tub 20. The water level sensor 350 may be installed in the tub 20. The water level sensor 350 may be positioned below the tub 20. The water level sensor 350 may be positioned at a rear portion of the tub 20 below the tub 20.

Figure 16A:
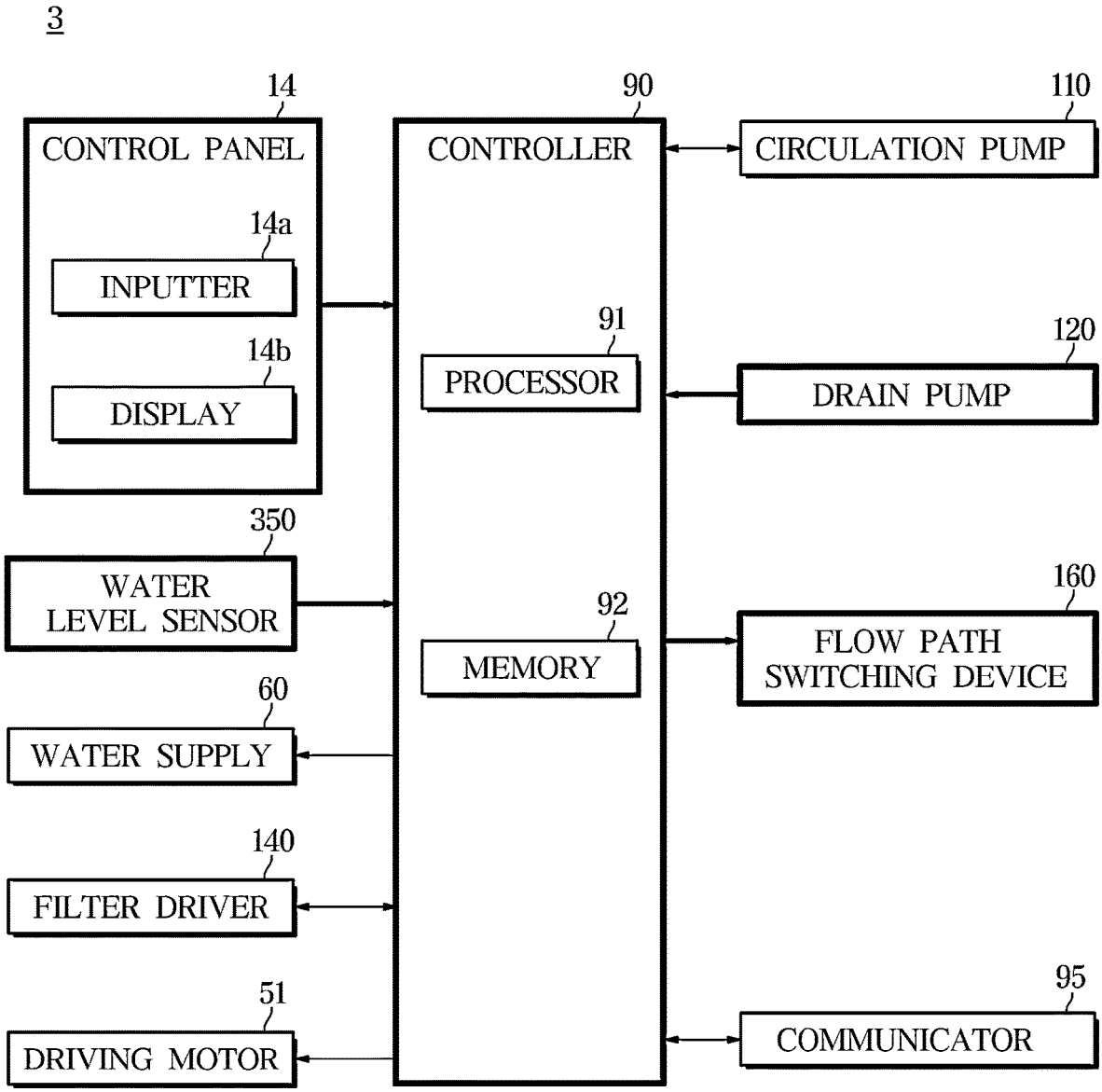
FIG. 16A is a block diagram briefly showing components of a washing machine according to an embodiment of the disclosure and a flow of signals between the components.
Figure 16B:
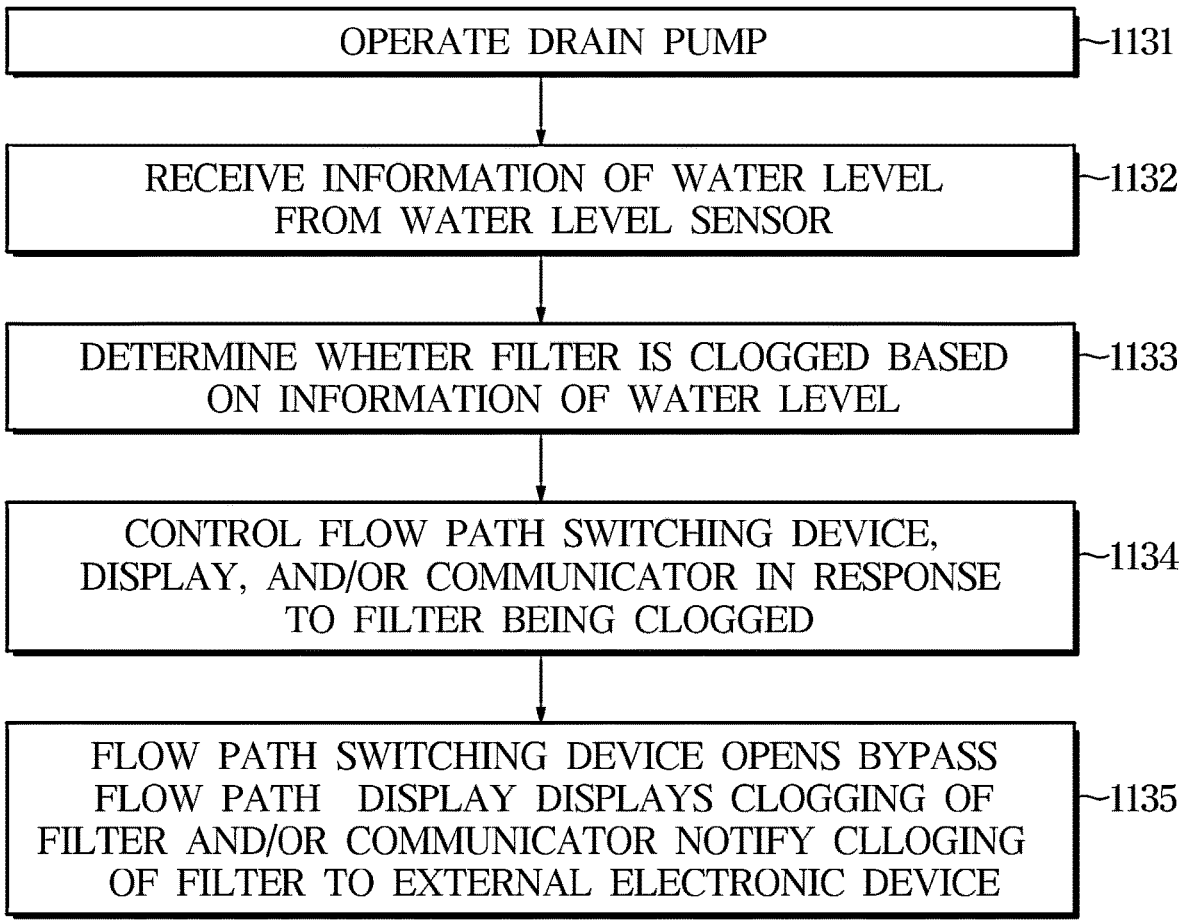
FIG. 16B is a flowchart showing a method for controlling a washing machine, according to an embodiment of the disclosure.

FIG. 16A is a block diagram briefly showing components of a washing machine according to an embodiment of the disclosure and a flow of signals between the components. FIG. 16B is a flowchart showing a method for controlling a washing machine, according to an embodiment of the disclosure.

A method for controlling the flow path switching device 160 of the pump device 100 of the washing machine 3 shown in FIG. 15 will be described with reference to FIGS. 16A and 16B.

Referring to FIG. 16A, the washing machine 3 may further include the water level sensor 350, in addition to the components shown in FIG. 11.

The water level sensor 350 may detect a frequency changing according to a water level while the drum 30 rotates.

According to an embodiment of the disclosure, the controller 90 may analyze a frequency (water level frequency) of an electrical signal corresponding to an input measured by the water level sensor 350 to identify a water level of the tub 20.

The controller 90 may drive the drain pump 120 to perform a drain operation.

In a case in which a drain operation is performed in a state in which the filter 131 is not clogged, a water level of the tub 20 may be reduced by a change amount that is within a preset range. Meanwhile, in a case in which a drain operation is performed in a state in which the filter 131 is clogged, a water level of the tub 20 may be reduced by a change amount that deviates from the preset range.

According to an embodiment of the disclosure, the water level sensor 350 may be an example of a sensor for obtaining information about a state of the filter 131.

Referring to 14B, the controller 90 may operate the drain pump 120 in response to an operation condition of the drain pump 120 being satisfied (1131). For example, the controller 90 may operate the drain pump 120 in response to drain operation being started.

While operating the drain pump 120, the controller 90 may receive information of water level from the water level sensor 350 (1132). According to the various embodiment, the water level sensor 350 may transmit a filter clogging detection signal to the controller 90 based on a change amount of a water level being smaller than a preset change amount. The filter clogging detection signal may be one example of information of water level.

According to the various embodiment, the controller 90 may identify whether the filter 131 is clogged based on the information of water level obtained from the water level sensor 350 (1133). For example, the controller 90 may identify whether the filter 131 is clogged, based on a change amount of a water level detected by the water level sensor 350. That is, while the controller 90 drives the drain pump 120, the controller 90 may identify whether the filter 131 is clogged, based on a change in water level of the tub 20.

According to an embodiment of the disclosure, the controller 90 may identify that the filter 131 is clogged, based on an identification that a change amount in water level of the tub 20 is less than or equal to a preset change amount, while the controller 90 operates the drain pump 120. Also, the controller 90 may identify that the filter 131 is not clogged, based on an identification that a change amount in water level of the tub 20 is more than the preset change amount, while the controller 90 operates the drain pump 120.

For example, the controller 90 may identify that the filter 131 is clogged in response to receiving the filter clogging detection signal from the water level sensor 350. The controller 90 may control the flow path switching device 160 to guide water entered the case 101 to the bypass flow path 172, based on the identification that the filter 131 is clogged (1134). The flow path switching device 160 may control the bypass door 165 to open the bypass flow path 172 based on a control signal from the controller 90 (1135).

The controller 90 may control the flow path switching device 160 to guide water entered the case 101 to the filtering flow path 171, based on the identification that the filter 131 is not clogged. The flow path switching device 160 may control the bypass door 165 to close the bypass flow path 172 based on a control signal from the controller 90.

According to various embodiments, based on the identification that the filter 131 is clogged, the controller 90 may control the display 14*b* to notify clogging of filter 131 (1134). According to various embodiments, based on the identification that the filter 131 is clogged, the controller 90 may control the communicator 95 to transmit a message to external electronic device(s) notifying clogging of filter 131 (1134).

The display 14*b* may output visual indications representing the clogging of filter 131 based on a control signal of the controller 90 (1135). The communicator 95 may transmit a message to external electronic device(s) notifying clogging of filter 131 based on a control signal of the controller 90 (1135).

In the current embodiment of the disclosure, the controller 90 may control the bypass door 165 to open the bypass flow path 172, based on an identification that a change amount in water level of the tub 20 is less than the preset change amount, while driving the drain pump 120, and based on an identification that a change amount in water level of the tub 20 is more than the preset change amount, the controller 90 may control the bypass door 165 to close the bypass flow path 172.

According to the current embodiment of the disclosure, the controller 90 may control the display 14*b* to output visual indications representing the clogging of filter 131 based on an identification that a change amount in water level of the tub 20 is less than the preset change amount.

According to the current embodiment of the disclosure, the controller 90 may control the communicator 95 to transmit a message to external electronic device(s) notifying clogging of filter 131 based on an identification that a change amount in water level of the tub 20 is less than the preset change amount.

According to various embodiments of the disclosure, at least one sensor for obtaining information about a state of the filter 131 may include a current sensor for detecting a value of driving current applied to the blade motor 141, a current sensor for detecting a value of driving current applied to the drain pump 120, the sensor 250, and/or the water level sensor 350.

Based on an identification that information about a state of the filter 131, obtained from at least two sensors, among information about a state of the filter 131, obtained from the at least one sensor, satisfies a condition in which the filter 131 is clogged, the controller 90 may identity that the filter 131 is clogged.

For example, while the controller 90 operates the drain pump 120, the controller 90 may identify that the filter 131 is clogged, based on an identification that a change amount in water level of the tub 20 is less than the preset change amount and a value of driving current applied to the drain pump 120 is greater than a preset value.

According to the disclosure, whether the filter 131 is clogged may be more correctly identified.

Figure 17:
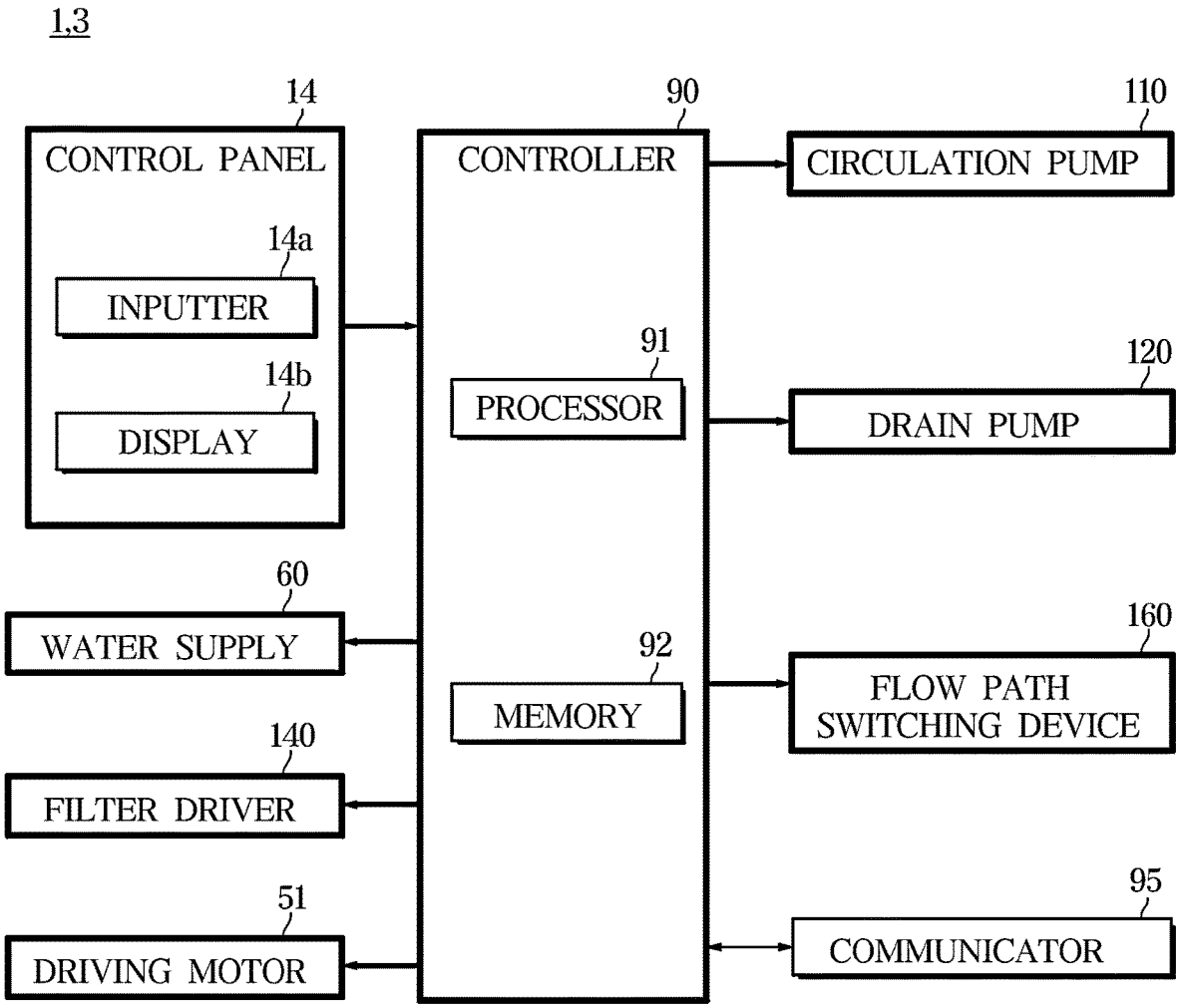
FIG. 17 is a block diagram briefly showing components of a washing machine according to an embodiment of the disclosure and a flow of signals between the components.

FIG. 17 is a block diagram briefly showing components of a washing machine according to an embodiment of the disclosure and a flow of signals between the components.

Referring to FIG. 17, the control panel 14 may receive a user input for starting a washing cycle. For example, a user may select a washing course or set a washing/rinsing/dehydrating function through a course selection dial (or a course selection button) and/or a washing/rinsing/dehydrating setting button of the inputter 14*a*, and start a washing cycle through a start button.

The controller 90 may perform a washing cycle based on reception of a user input for starting a washing cycle through the control panel 14.

According to an embodiment of the disclosure, the controller 90 may control the driving motor 51, the water supply 60, the circulation pump 110, the drain pump 120, and/or the filter driver 140 to perform a washing cycle.

For example, the processor 91 may control the driving motor 51, the water supply 60, the circulation pump 110, the drain pump 120, and/or the filter driver 140 based on execution of a program stored in the memory 92.

Figure 18:
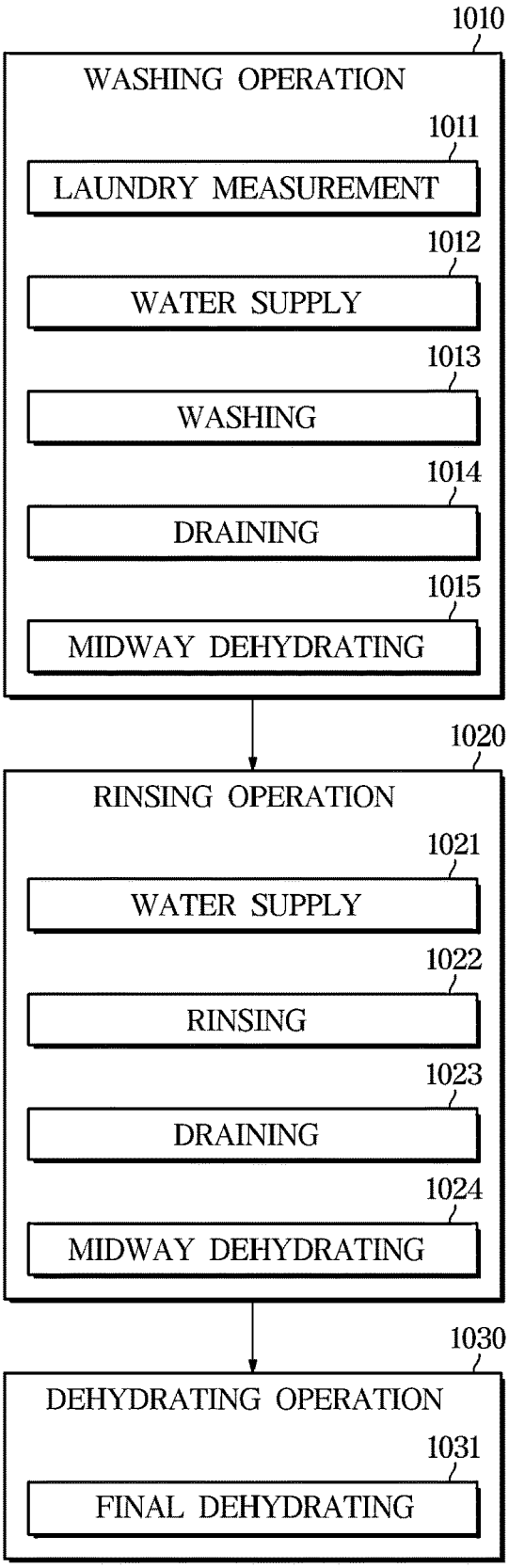
FIG. 18 shows an example of a washing cycle according to an embodiment of the disclosure.

FIG. 18 shows an example of a washing cycle according to an embodiment of the disclosure.

Referring to FIG. 18, an operation time of the filter driver 140 and an operation time of the pump device 100 will be described.

Referring to FIG. 18, the washing machine 1 or 3 may perform a washing operation 1010, a rinsing operation 1020, and a dehydrating operation 1030 sequentially according to a user input through the inputter 14*a*.

By the washing operation 1010, laundry may be washed. More specifically, foreign materials attached to the laundry may be separated from the laundry by chemical actions by a detergent and/or mechanical actions such as falling.

The washing operation 1010 may include a laundry measurement operation 1011 of measuring an amount of laundry, a water supply operation 1012 of supplying water to the tub 20, a washing operation 1013 of rotating the drum 30 at low speed to wash laundry, a drain operation 1014 of draining water stored in the tub 20, and a midway dehydrating operation 1015 of rotating the drum 30 at high speed to separate water from laundry.

For the laundry measurement operation 1011, the controller 90 may control a driving circuit to repeatedly turn on/off the driving motor 51, and measure a load (a weight of the laundry) in the drum 30 based on a counter electromotive force value generated upon turning-off of the driving motor 51.

For the water supply operation 1012, the controller 90 may control the water supply 60 to provide water supplied from an external water supply source to the inside of the tub 20.

For the washing operation 1013, the controller 90 may control the driving circuit to rotate the driving motor 51 forward (for example, a clockwise direction) or backward (for example, a counterclockwise direction). By rotating the drum 30, the laundry may fall from an upper area of the drum 30 to a lower area of the drum 30, and by the falling, the laundry may be washed.

During the washing operation 1013, a circulation operation of causing water in the tub 20 to pass through the pump device 100 and again enter the tub 20 may be performed. By the circulation operation of causing water from which foreign materials have been removed to enter the inside of the tub 20, more efficient washing may be performed.

The controller 90 may drive the circulation pump 110 for the circulation operation.

For the drain operation 1014, the controller 90 may drive the drain pump 120.

Also, the controller 90 may drive the blade motor 141 based on an operation of the drain pump 120.

Accordingly, during the drain operation 1014, foreign materials collected in the filter 131 may move to one side of the filter 131.

As described above, the controller 90 may control the flow path switching device 160 to open the bypass flow path 172 based on an identification that the filter 131 is clogged, during the drain operation 1014.

For the midway dehydrating operation 1015, the controller 90 may control the driving circuit to rotate the driving motor 51 at high speed. By the high-speed rotation of the drum 30, water may be separated from the laundry accommodated in the drum 30 and discharged to the outside of the washing machine 1.

By the rinsing operation 1020, the laundry may be rinsed. More specifically, a detergent or foreign materials remaining in the laundry may be washed away by water.

The rinsing operation 1020 may include a water supply operation 1021 of supplying water to the tub 20, a rinsing operation 1022 of driving the drum 30 to rinse laundry, a drain operation 1023 of discharging water stored in the tub 20, and a midway dehydrating operation 1024 of driving the drum 30 to separate water from the laundry.

The water supply operation 1021, the drain operation 1023, and the midway dehydrating operation 1024 of the rinsing operation 1020 may be the same as the water supply operation 1012, the drain operation 1014, and the midway dehydrating operation 1015 of the washing operation 1010, respectively. During the rinsing operation 1020, the water supply operation 1021, the rinsing operation 1022, the drain operation 1023, and the midway dehydrating operation 1024 may be performed one time or several times.

For the drain operation 1023, the controller 90 may drive the drain pump 120.

Also, the controller 90 may drive the blade motor 141 based on an operation of the drain pump 120.

Accordingly, foreign materials collected in the filter 131 during the drain operation 1023 may move to one side of the filter 131.

By the dehydrating operation 1030, the laundry may be dehydrated. More specifically, water may be separated from the laundry by a high-speed rotation of the drum 30, and the separated water may be discharged to the outside of the washing machine 1.

The dehydrating operation 1030 may include a final dehydrating operation 1031 of separating water from laundry by rotating the drum 30 at high speed. Due to the final dehydrating operation 1031, a final midway dehydrating operation 1024 of the rinsing operation 1020 may be omitted.

For the final dehydrating operation 1031, the controller 90 may control the driving circuit to rotate the driving motor 51 at high speed. By the high-speed rotation of the drum 30, water may be separated from the laundry accommodated in the drum 30, and discharged to the outside of the washing machine 1. Also, a rotation speed of the driving motor 51 may increase in stages.

Because an operation of the washing machine 1 terminates by the final dehydrating operation 1031, a time for which the final dehydrating operation 1031 is performed may be longer than a time for which the midway dehydrating operation 1015 or 1024 is performed.

According to various embodiments of the disclosure, during the dehydrating operation 1030, a drain operation may be performed. For example, the controller 90 may operate the drain pump 120 during the dehydrating operation 1030.

In the disclosure, the drain operation may be all operations in which the drain pump 120 operates.

Figure 19:
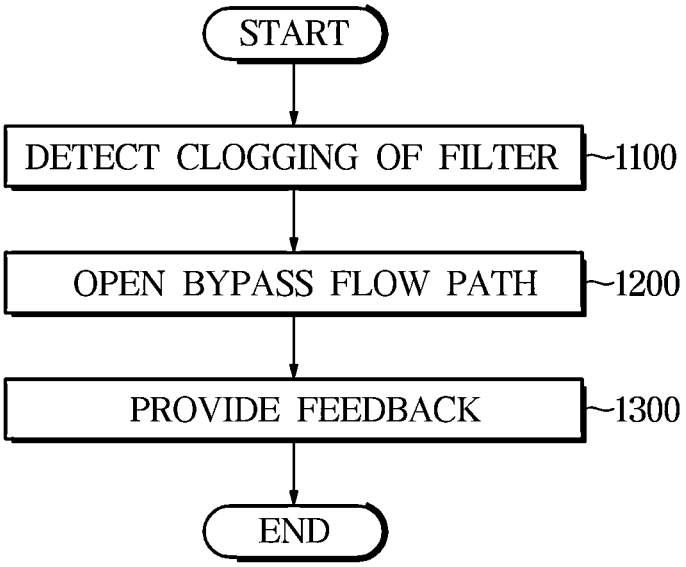
FIG. 19 is a flowchart showing a method for controlling a washing machine, according to an embodiment of the disclosure.

FIG. 19 is a flowchart showing a method for controlling a washing machine, according to an embodiment of the disclosure.

Referring to FIG. 19, the controller 90 may receive information about a state of the filter 131 from at least one sensor for acquiring information about a state of the filter 131, and identify whether the filter 131 is clogged.

Based on an identification that the filter 131 is clogged, the controller 90 may control the flow path switching device 160 to open the bypass flow path 172 (1200).

Upon clogging of the filter 131, by opening the bypass flow path 172, a case in which water is temporarily not drained may be prevented. However, upon opening of the bypass flow path 172, water discharged from the washing machine 1 or 3 to the outside may not pass through the filter 131.

In a case in which water not passed through the filter 131 is discharged to the outside, an environmental issue may be caused. Accordingly, opening the bypass flow path 172 for a long time is not desirable in view of an environmental issue.

According to various embodiments of the disclosure, the controller 90 may provide a feedback for notifying a user of clogging of the filter 131, based on an identification that the filter 131 is clogged (1300).

For example, the controller 90 may control the display **14*b* to output a visual feedback representing clogging of the filter 131. The visual feedback representing clogging of the filter 131** may include various visual indications, such as a character, a figure, a symbol, an icon, an image, and/or an animation.

As another example, in a case in which the washing machine 1 or 3 includes a speaker, the controller 90 may control the speaker to output an auditory feedback representing clogging of the filter 131. The auditory feedback representing clogging of the filter 131 may include various sounds, such as a beep sound, a voice, etc.

As another example, the controller 90 may control the communicator 95 to transmit a message notifying clogging of the filter 131 to a user terminal.

A user may check clogging of the filter 131 according to at least one feedback.

According to an embodiment of the disclosure, by notifying a user of clogging of the filter 131, a quick filter management may be induced.

According to various embodiments of the disclosure, the user terminal that has received the message notifying clogging of the filter 131 from the communicator 95 may provide an interface inducing interruption of a washing cycle. The interface inducing interruption of the washing cycle may include a user interface element for receiving an input of interrupting a washing cycle.

The user terminal may transmit an operation stop command to the communicator 95 in response to a selection of the user interface element. The operation stop command may be a command for interrupting a washing cycle being performed by the washing machine 1 or 3.

The controller 90 may stop a washing cycle by receiving the operation stop command from the user terminal through the communicator 95. Thereafter, the user may resume the interrupted washing cycle by replacing the filter 131 and then pressing the start button.

According to the disclosure, the user may be induced to reduce an amount of foreign materials that are discharged to the outside of the washing machine 1 or 3.

Meanwhile, the washing cycle may include at least two drain operations 1014 and 1023.

Before a second drain operation 1023 is performed after a first drain operation 1014 is completed, the washing cycle may stop. In this case, upon resuming of the washing cycle, at least one of a midway dehydrating operation 1015, a water supply operation 1021, or a rinsing operation 1022 may need to be performed. However, because the drain pump 120 does not operate in the midway dehydrating operation 1015, the water supply operation 1021, and the rinsing operation 1022, no foreign materials may be discharged to the outside, and accordingly, the washing cycle may need not to stop immediately.

The controller 90 may receive an operation stop command from a user terminal through the communicator 95 before the second drain operation 1023 is performed after the first drain operation 1014 is completed. In this case, the controller 90 may stop the washing cycle at a start time (or an end time of a rinsing operation 1022) of the second drain operation 1023.

According to the disclosure, upon resuming of the washing cycle, a consumption time for completing the washing cycle may be reduced.

Also, for the same reason, because the drain pump 120 does not operate after the second drain operation 1023 is completed, no foreign materials may be discharged to the outside, and accordingly, the washing cycle may need not to stop.

The controller 90 may complete the washing cycle by receiving an operation stop command from the user terminal through the communicator 95 after the second drain operation 1023 is completed.

According to the disclosure, under a condition in which a washing cycle does not need to stop, a washing cycle may be completed regardless of a user's command.

Meanwhile, in a case in which a user uses the washing machine 1 or 3 for a long time without managing the filter 131, foreign materials may be continuously discharged to the outside during a drain operation.

According to various embodiments of the disclosure, in a case in which the washing machine 1 or 3 does not include the sensor 250, the controller 90 may itself not detect clogging of the filter 131.

Accordingly, in a case in which a washing cycle terminates while the bypass flow path 172 opens, the controller 90 may control the flow path switching device 160 to again close the bypass flow path 172.

In a case in which the bypass flow path 172 opens in all of a plurality of washing cycles successively performed, it is obvious that a user has not replaced or repaired the filter 131.

Accordingly, in a case in which the bypass flow path 172 opens in all of a plurality of washing cycles successively performed, the washing machine 1 or 3 may change a start condition of a washing cycle to a more detailed condition.

For example, in the case in which the bypass flow path 172 opens in all of a plurality of washing cycles successively performed, the controller 90 may provide a feedback requesting management of the filter 131, instead of starting a washing cycle based on reception of a user input for starting a washing cycle.

After the controller 90 provides the feedback requesting management of the filter 131, the controller 90 may start a washing cycle by again receiving a user input for starting a washing cycle.

According to the disclosure, a situation in which water not passed through the filter 131 is continuously discharged to the outside may be easily prevented.

Meanwhile, according to various embodiments of the disclosure, in a case in which the washing machine 1 or 3 includes the sensor 250, the controller 90 may itself detect clogging of the filter 131.

In a case in which the washing machine 1 or 3 detects clogging of the filter 131 through the sensor 250 in all of a plurality of washing cycles successively performed, the washing machine 1 or 3 may change a start condition of a washing cycle to a more detailed condition.

For example, in a case in which the controller 90 detects clogging of the filter 131 through the sensor 250 in all of a plurality of washing cycles successively performed, the controller 90 may provide a feedback requesting management of the filter 131, instead of starting a washing cycle based on reception of a user input for starting a washing cycle.

After the controller 90 provides the feedback requesting management of the filter 131, the controller 90 may start a washing cycle based on reception of a user input for starting a washing cycle in a state in which clogging of the filter 131 is not detected.

According to the disclosure, a situation in which water not passed through the filter 131 is continuously discharged to the outside may be obligatorily prevented.

According to a concept of the disclosure, because the flow path switching device is provided in the pump device, the washing machine may discharge water from the pump device although a portion of the filter is clogged.

According to a concept of the disclosure, because the flow path switching device is provided in the pump device, the washing machine may discharge water from the pump device although a portion of the filter is clogged, and accordingly, the washing machine may be prevented from stopping.

However, effects that may be achieved by the disclosure are not limited to the above-mentioned effects, and other effects not mentioned will be clearly understood by one of ordinary skill in the technical field to which the disclosure belongs from the following descriptions.

Although specific embodiments of the disclosure have been described, the disclosure is not limited to the above-described specific embodiments, and it is obvious that various modifications can be made by persons of ordinary skill in the technical art to which the disclosure belongs without deviating from the gist of the disclosure set forth in the claims, and the modifications surely reside in the scope of the claims.

What is claimed is:

1. A washing machine comprising:

a housing;

a tub inside the housing;

a case connected with the tub;

a filter attachable to or detachable from the case;

a filtering flow path formed to pass through a portion of the filter;

a bypass flow path formed to bypass the portion of the filter;

at least one sensor configured to obtain information about a state of the filter;

a flow path switching device configured to guide water entered into the case to the filtering flow path or the bypass flow path, the flow path switching device comprising:

a bypass body installed at an outer circumference of the case and configured to form the bypass flow path;

a bypass door rotatably installed inside the bypass body and configured to open or close the bypass flow path; and a bypass driver installed on the bypass body and configured to operate the bypass door; and a controller configured to control the flow path switching device to guide the water based on the obtained information about the state of the filter.

2. The washing machine of claim 1, wherein the bypass door is positioned at a location at which the filtering flow path and the bypass flow path diverge.

3. The washing machine of claim 1, wherein the case comprises an inlet and a drain opening, and the bypass door is positioned on a drain flow path connecting the inlet with the drain opening.

4. The washing machine of claim 1, wherein the flow path switching device comprises a bypass body rotatably supporting the bypass door and installed in the case.

5. The washing machine of claim 1, wherein the filter comprises a first filter portion to filter the water to remove a first foreign material, and a second filter portion configured to filter the water that has been filtered by the first filter portion to remove a second foreign material that is smaller than the first foreign material and not filtered by the first filter portion, the filtering flow path is configured to pass through the second filter portion so that the water is filtered by both the first filter portion and the second filter portion, and the bypass flow path is configured to bypass the second filter portion.

6. The washing machine of claim 1, further comprising:

a pump configured to suck water into inside of the case and discharge the water inside of the case to outside of the case; and a pump motor configured to drive the pump, wherein the at least one sensor comprises a current sensor configured to detect a driving current value applied to the pump motor-, and the information includes the detected driving current value applied to the pump motor.

7. The washing machine of claim 1, wherein the at least one sensor comprises a water level sensor configured to detect a water level of the tub, and the information includes the detected water level of the tub.

8. The washing machine of claim 1, wherein the at least one sensor comprises an optical sensor configured to detect an amount of foreign materials collected in the filter-, and the information includes the detected amount of foreign materials collected in the filter.

9. The washing machine of claim 1, further comprising:

a filter blade slidably and rotatably inserted onto an inner surface of the filter; and a blade motor configured to rotate the filter blade, wherein the at least one sensor comprises a current sensor configured to detect a driving current value applied to the blade motor.

10. The washing machine of claim 1, wherein the controller is configured to control the flow path switching device to guide the water entered into the case to the bypass flow path, based on an identification, included in the obtained information, that the filter is clogged.

11. The washing machine of claim 1, wherein the controller is configured to control the flow path switching device to guide the water entered into the case to the filtering flow path, based on an identification, included in the obtained information, that the filter is not clogged.

12. The washing machine of claim 1, further comprising a display, wherein the controller is configured to control the display to display a visual feedback notifying clogging of the filter, based on a detection of clogging of the filter by the at least one sensor.

13. The washing machine of claim 1, further comprising a communicator, wherein the controller is configured to control the communicator to transmit a filter clogging notification message to a user terminal based on a detection of clogging of the filter by the at least one sensor.

14. The washing machine of claim 13, wherein the controller is configured to interrupt a washing cycle upon receiving of an operation stop command from the user terminal through the communicator.

15. A washing machine comprising:

a tub;

a case connected with the tub;

a filter attachable to or detachable from the case;

at least one sensor configured to detect clogging of the filter;

a flow path switching device configured to guide water entered into the case to pass through the filter or bypass the filter, the flow path switching device comprising:

a bypass body installed at an outer circumference of the case and configured to form a bypass flow path;

a bypass door rotatably installed inside the bypass body and configured to open or close the bypass flow path; and a bypass driver installed on the bypass body and configured to operate the bypass door; and a controller configured to control the flow path switching device based on the clogging of the filter detected by the at least one sensor.

16. The washing machine of claim 15, wherein the filter comprises a first filter portion, and a second filter portion configured to filter a foreign material that is not filtered by the first filter portion, the bypass door is adjacent to a location at which the first filter portion is connected with the second filter portion.

17. The washing machine of claim 15, further comprising:

a filter blade slidably and rotatably inserted onto an inner surface of the filter; and a blade motor configured to rotate the filter blade, wherein the at least one sensor comprises a current sensor configured to detect a driving current value applied to the blade motor.

18. The washing machine of claim 1, wherein the state of filter includes clogging of the filter, and in response to obtaining the information of the clogging of the filter, the controller is configured to control the bypass door to open the bypass flow path to guide the water to the bypass flow path.

19. A method for controlling a washing machine, the washing machine including a tub, a case connected with the tub, a filter attachable to or detachable from the case, at least one sensor, a flow path switching device, and a controller the method comprising:

detecting of clogging of the filter using the at least one sensor; and controlling the flow path switching device, by the controller, to guide water entered into the case to pass through the filter or bypass the filter based on the detecting of clogging of the filter, wherein the flow path switching device includes:

a bypass body installed at an outer circumference of the case and forming a bypass flow path;

a bypass door rotatably installed inside the bypass body; and a bypass driver installed on the bypass body, and configured to operate the bypass door to open or close the bypass flow path.

* * * * *